US010852660B2

(12) United States Patent
Ikada et al.

(10) Patent No.: US 10,852,660 B2
(45) Date of Patent: Dec. 1, 2020

(54) IMAGE FORMING APPARATUS THAT REGULATES DEVELOPING AGENT AND APPLIES REGULATORY BIAS

(71) Applicant: CANON KABUSHIKI KAISHA, Tokyo (JP)

(72) Inventors: Kosuke Ikada, Machida (JP); Katsuichi Abe, Susono (JP); Kodai Hayashi, Suntou-gun (JP); Yasukazu Ikami, Tokyo (JP); Shinichi Hagiwara, Tokyo (JP); Shuhei Kawasaki, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/676,585

(22) Filed: Nov. 7, 2019

(65) Prior Publication Data

US 2020/0150555 A1 May 14, 2020

(30) Foreign Application Priority Data

Nov. 14, 2018 (JP) ..... 2018-213853

(51) Int. Cl.
*G03G 15/08* (2006.01)

(52) U.S. Cl.
CPC ..... *G03G 15/08* (2013.01); *G03G 15/0812* (2013.01)

(58) Field of Classification Search
CPC ..... G03G 15/0812; G03G 15/08
USPC ..... 399/284, 285
See application file for complete search history.

(56) References Cited

U.S. PATENT DOCUMENTS

| | | | | |
|---|---|---|---|---|
| 9,778,583 | B2 | 10/2017 | Terauchi | |
| 2013/0136508 | A1* | 5/2013 | Nakagawa | G03G 13/08 399/285 |
| 2017/0277067 | A1* | 9/2017 | Noguchi | G03G 15/065 |
| 2018/0210374 | A1* | 7/2018 | Yagi | G03G 15/162 |
| 2018/0329327 | A1* | 11/2018 | Yamawaki | G03G 9/0825 |

FOREIGN PATENT DOCUMENTS

| | | | |
|---|---|---|---|
| JP | 2000047545 | A | 2/2000 |
| JP | 2005121833 | A | 5/2005 |
| JP | 2005173021 | A | 6/2005 |
| JP | 2005326475 | A | 11/2005 |
| JP | 2016038591 | A | 3/2016 |

* cited by examiner

*Primary Examiner* — Robert B Beatty
(74) *Attorney, Agent, or Firm* — Rossi, Kimms & McDowell LLP

(57) ABSTRACT

An image forming apparatus includes a regulating member that regulates a developing agent that a developing agent carrying member carries in order to develop an electrostatic image, and a regulatory bias application portion that applies a regulatory bias to the regulating member, wherein the developing agent includes a toner containing a toner particle, inorganic silicon fine particles present on the surface of the toner particle, and a metal soap, wherein the amount of water-washing migration of the inorganic silicon fine particles is 0.20 mass % or less, wherein a peripheral speed ratio, which is a ratio of a peripheral speed of the developing agent carrying member to a peripheral speed of an image bearing member, has a range of 120% to 300%, and a dark portion potential Vd on the surface of the image bearing member and a regulatory bias Vb satisfy the relationship of Vd<Vb.

25 Claims, 11 Drawing Sheets

$\theta = 100°$

A-A CROSS SECTION

IMAGE FORMING APPARATUS THAT REGULATES DEVELOPING AGENT AND APPLIES REGULATORY BIAS

BACKGROUND OF THE INVENTION

Field of the Invention

The present invention relates to an electrophotographic image forming apparatus. Here, the electrophotographic image forming apparatus (hereinafter simply referred to as an "image forming apparatus") forms an image on a recording member (recording medium) using an electrophotographic image forming system.

Description of the Related Art

In the related art, regarding an electrophotographic photosensitive member (hereinafter simply referred to as a "photosensitive member") used in an electrophotographic image forming apparatus, an organic photosensitive member has been widely used because it has advantages such as low price and high productivity. In this configuration, a photosensitive layer (organic photosensitive layer) using an organic material as a photoconductive material (a charge generating substance and a charge transport substance) is provided on a support. Regarding an organic photosensitive member, a photosensitive member having a laminated type photosensitive layer is mainly used because it has advantages such as high sensitivity and a variety of material designs. In this configuration, a charge generation layer containing a charge generating substance such as a photoconductive dye and a photoconductive pigment and a charge transport layer containing a charge transport substance such as a photoconductive polymer and a photoconductive low-molecular-weight compound are laminated.

Since an electrical external force and/or a mechanical external force are directly applied to the surface of the photosensitive member during charging, exposing, developing, transferring, and cleaning, durability against these external forces is required for the photosensitive member. Specifically, durability against the occurrence of scratches and wear on the surface due to these external forces, that is, scratch resistance and wear resistance, are required.

Generally, the following technologies are known as a technology for improving scratch resistance and wear resistance on the surface of an organic photosensitive member:

A photosensitive member having a cured layer using a curable resin as a binder resin as a surface layer. A photosensitive member having a charge transportable cured layer formed by curing and polymerizing a monomer having a carbon-carbon double bond and a charge transportable monomer having a carbon-carbon double bond with heat or light energy as a surface layer.

A photosensitive member having a charge transportable cured layer formed by curing and polymerizing a hole transportable compound having a chain polymerizable functional group in the same molecule with electron beam energy as a surface layer.

In addition, in recent years, along with increasing market need for higher speeds and longer lifespans of image forming apparatuses, a photosensitive member having higher scratch resistance and higher wear resistance than conventional ones has been required. In order to meet this requirement, a photosensitive member having a wear-resistant protective layer (over coat layer: OCL) on the surface layer of the photosensitive member has been developed, and a technology for increasing the mechanical strength of the surface layer has been established.

However, when wear of the photosensitive member is reduced, the surface of the photosensitive member is less likely to be refreshed, and blurring of an electrostatic latent image called "image smearing" is likely to occur particularly in a high humidity environment. The cause of the image smearing is thought to be follows. A discharge product such as ozone and $NO_x$ is generated mainly by a charging portion and adheres to the surface of the photosensitive member. The surface of the photosensitive member has a low surface friction coefficient and is hard and is unlikely to be scraped off, and the discharge products adhered to the surface are unlikely to be removed. Then, the discharge products which adhere to the surface of the photosensitive member and which are unlikely to be removed absorb water in a high humidity environment and a charge retention ability of the surface of the photosensitive member is reduced, and blurring of the electrostatic latent image is caused.

Therefore, in particular, when the hardness of the photosensitive member is high, it becomes more difficult to remove the discharge products adhered to its surface, and image smearing tends to occur.

Regarding a method of preventing image defects due to the discharge products, for example, such as image smearing:

Japanese Patent Application Publication No. 2005-173021 proposes that a heater is disposed around a photosensitive member, and in order to reduce power consumption, it is determined whether the heater will perform an operation by detecting a load torque of a motor generated when the photosensitive member is driven to rotate.

However, when the heater is disposed, the size of the image forming apparatus increases and power consumption increases. In addition, downtime such as during heating control occurs and usability decreases.

In Japanese Patent Application Publication No. 2000-47545, a method in which abrasive particles for polishing the surface of the photosensitive member are added to a developing agent in the developing portion has been proposed. In this method, abrasive particles accumulate on the cleaning portion in contact with the photosensitive member from the developing portion via the photosensitive member, the surface of the photosensitive member is rubbed with abrasive particles, and thereby the discharge product is removed.

In Japanese Patent Application Publication No. 2005-326475, a method in which a hydrotalcite compound, which is an anion-exchangeable intercalation compound, is incorporated into a developing agent and the hydrotalcite compound is supplied from a developing agent carrying member to the surface of a photosensitive member is proposed. When the anion-exchangeable intercalation compound is supplied, since a discharge product that causes a decrease in resistance is incorporated between host layers of the anion-exchangeable intercalation compound, the discharge product can be deactivated.

In addition, Japanese Patent Application Publication No. 2005-121833 proposes a method in which a metal soap is incorporated into a developing agent, and the metal soap is supplied from a developing agent carrying member to the surface of the photosensitive member. In this method, zinc stearate as a metal soap is supplied through a developing portion, covers the surface of the photosensitive member, and the image smearing is reduced while maintaining wear resistance.

SUMMARY OF THE INVENTION

However, in the configuration in which an external additive is used as in Japanese Patent Application Publication No. 2000-47545, Japanese Patent Application Publication No. 2005-326475, and Japanese Patent Application Publication No. 2005-121833, when a development device is used, an external additive is released and it is difficult to reduce image smearing throughout the lifespan of the development device.

Thus, an object of the present invention is to provide an image forming apparatus that can reduce the occurrence of image smearing by controlling release of an external additive even in a configuration in which durability of a photosensitive member is maintained.

In order to achieve the above object, an image forming apparatus according to the present invention includes:

an image bearing member;

a latent image forming portion that forms a bright portion potential and a dark portion potential on a surface of the image bearing member and thus forms an electrostatic image on the image bearing member;

a developing agent carrying member that comes in contact with the image bearing member and develops the electrostatic image formed on the image bearing member using a developing agent;

a regulating member that regulates the developing agent that the developing agent carrying member carries in order to develop the electrostatic image; and a regulatory bias application portion that applies a regulatory bias to the regulating member;

wherein the developing agent includes a toner containing a toner particle, inorganic silicon fine particles present on a surface of the toner particle, and a metal soap, wherein the amount of water-washing migration of the inorganic silicon fine particles is 0.20 mass % or less, wherein a peripheral speed ratio that is a ratio of a peripheral speed of the developing agent carrying member to a peripheral speed of the image bearing member has a range of 120% to 300%, and wherein a dark portion potential Vd on the surface of the image bearing member and a regulatory bias Vb satisfy the relationship of Vd<Vb.

Furthermore, in order to achieve the above object, an image forming apparatus according to the present invention includes:

an image bearing member;

a latent image forming portion that forms a bright portion potential and a dark portion potential on a surface of the image bearing member and thus forms an electrostatic image on the image bearing member;

a developing agent carrying member that comes in contact with the image bearing member and develops the electrostatic image formed on the image bearing member using a developing agent;

a regulating member that regulates the developing agent that the developing agent carrying member carries in order to develop the electrostatic image; and a regulatory bias application portion that applies a regulatory bias to the regulating member;

wherein the developing agent includes a toner containing a toner particle, organosilicon polymers covering the surface of the toner particle, and a metal soap, wherein the amount of water-washing migration of the organosilicon polymers is 0.20 mass % or less, wherein the Martens hardness of the toner measured in a condition of a maximum load of $2.0\times10^{-4}$ N is at least 200 MPa and not more than 1,100 MPa, wherein a peripheral speed ratio, which is a ratio of a peripheral speed of the developing agent carrying member to a peripheral speed of the image bearing member, has a range of 120% to 300%, and wherein a dark portion potential Vd on the surface of the image bearing member and a regulatory bias Vb satisfy the relationship of Vd<Vb.

According to the present invention, it is possible to provide an image forming apparatus that can reduce the occurrence of image smearing by a simple configuration and control without increasing the size of the main body, power consumption, and downtime while maintaining durability of a photosensitive member.

Further features of the present invention will become apparent from the following description of exemplary embodiments with reference to the attached drawings.

DESCRIPTION OF THE EMBODIMENTS

In the present invention, the statement "at least ○○ and not more than xx" and "○○ to xx" indicating a numerical range refers to a numerical range including the lower limit and the upper limit which are end points unless otherwise noted.

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment

Overall Schematic Configuration of Image Forming Apparatus

Figure 1:
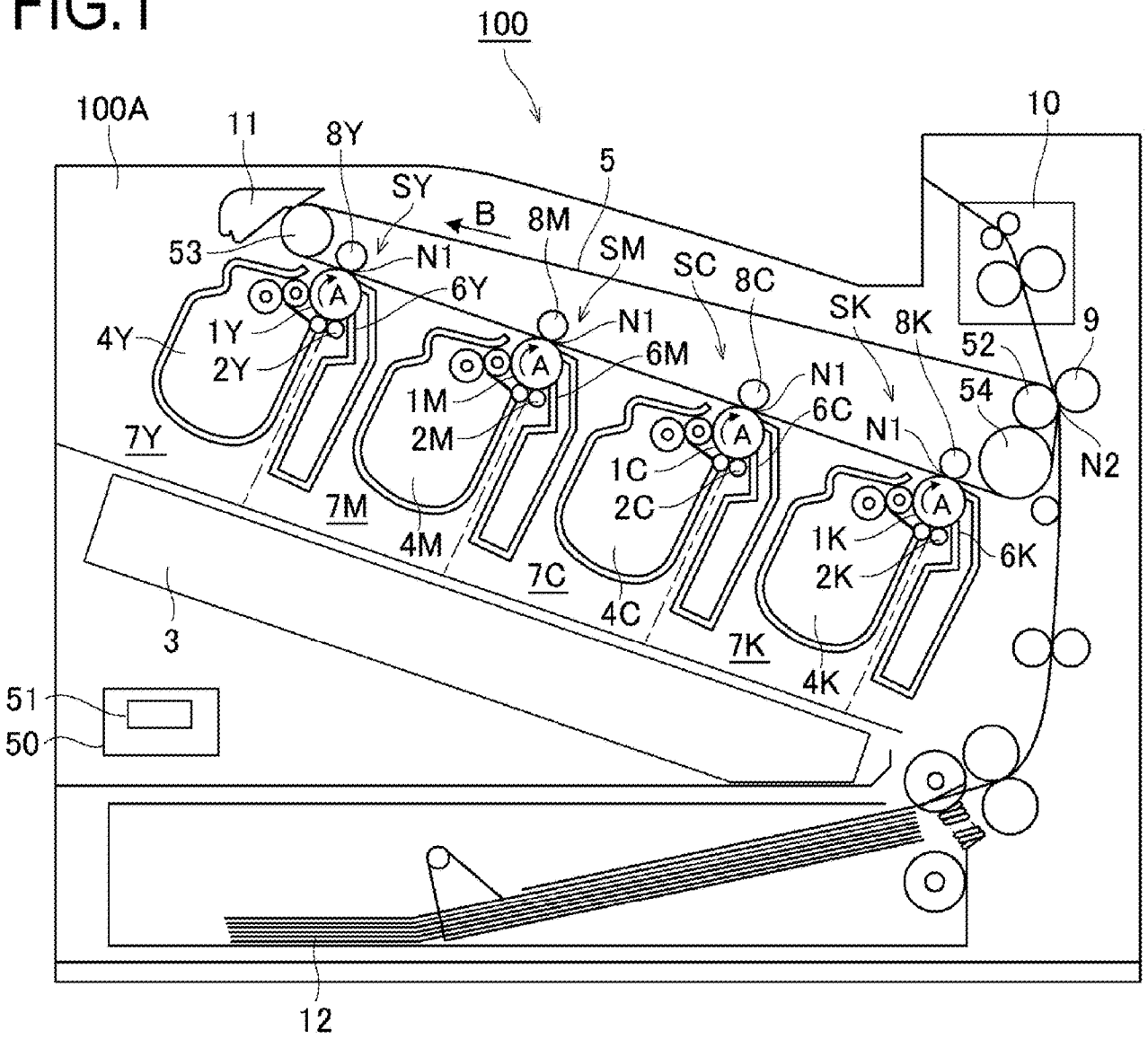
FIG. 1 is a schematic cross-sectional view of an image forming apparatus.

An overall configuration of an electrophotographic image forming apparatus (image forming apparatus) according to an embodiment of the present invention will be described with reference to FIG. 1. FIG. 1 is a schematic cross-sectional view of an image forming apparatus 100 of a form (embodiment) for implementing the present invention. The image forming apparatus 100 according to the embodiment is a full-color laser printer using an inline system and an intermediate transfer system. The image forming apparatus 100 can form a full-color image on a recording member (for example, recording paper, a plastic sheet, cloth, etc.) according to image information. The image information is input to a CPU 51 provided in an engine controller 50 from an image reading device connected to an image forming apparatus main body 100A or a host device such as a personal computer that is communicatively connected to the image forming apparatus main body 100A.

The image forming apparatus 100 includes, as a plurality of image forming portions, first, second, third, and fourth image forming portions SY, SM, SC, and SK for forming images of respective colors of yellow (Y), magenta (M), cyan (C), and black (K). In the present embodiment, the first to fourth image forming portions SY, SM, SC, and SK are disposed in a line in a direction intersecting the vertical direction.

Here, in the embodiment, the configurations and operations of the first to fourth image forming portions SY, SM, SC, and SK are substantially the same except that colors of images to be formed are different from each other. Therefore, unless there is a particular distinction below, subscripts Y, M, C, and K that are added to the reference numerals in order to indicate that they are elements provided for certain colors will be omitted and the portions will be generally described.

In the embodiment, the image forming apparatus 100 includes, as a plurality of image bearing members, four drum type electrophotographic photosensitive members provided side by side in a direction intersecting the vertical direction, that is, photosensitive drums 1. The photosensitive drum 1 is driven to rotate by a drive portion (driving source) in a direction indicated by the arrow A (clockwise) in the drawing. A charging roller 2 as a charging portion for uniformly charging the surface of the photosensitive drum 1 and a scanner unit (exposure apparatus) 3 as a exposure portion for forming an electrostatic image (electrostatic latent image) on the photosensitive drum 1 by emitting a laser beam based on the image information are disposed around the photosensitive drum 1. In addition, a development unit (development device) 4 as a developing portion for developing an electrostatic image as a toner image (developing agent image) and a cleaning member 6 as a cleaning portion for removing the toner (residual transfer toner) remaining on the surface of the photosensitive drum 1 after transfer are disposed around the photosensitive drum 1. In addition, an intermediate transfer belt 5 as an intermediate transfer member for transferring a toner image on the photosensitive drum 1 to a recording member 12 is disposed so that it faces the four photosensitive drums 1.

Here, in the embodiment, the development unit 4 uses a toner which is a non-magnetic one-component developing agent having negatively charged polarity as a developing agent. In addition, in the embodiment, the development unit 4 performs reverse development by bringing a developing roller (to be described below) as a developing agent carrying member into contact with the photosensitive drum 1. That is, in the present embodiment, the development unit 4 develops an electrostatic image by adhering a toner charged to the same polarity (negative polarity, in the present embodiment) as the charging polarity of the photosensitive drum 1 to a portion (image portion, exposure portion) on the photosensitive drum 1 in which the charge is attenuated due to exposure.

In the embodiment, the photosensitive drum 1 and the charging roller 2, and the development unit 4 and the cleaning member 6 as processing portions acting on the photosensitive drum 1 are integrated, that is, formed into an integrated cartridge, to form a process cartridge 7. The process cartridge 7 is removable (detachable) from the image forming apparatus 100 via a mounting portion such as a mounting guide and a positioning member provided in the image forming apparatus main body 100A. In the present embodiment, all of the process cartridges 7 for respective colors have the same form, and toners for yellow (Y), magenta (M), cyan (C), and black (K) colors are stored in the process cartridges 7 for respective colors.

The intermediate transfer belt 5 formed in an endless belt as the intermediate transfer member comes in contact with all of the photosensitive drums 1 and circulates (rotates) in a direction indicated by the arrow B in the drawing (counterclockwise). The intermediate transfer belt 5 is wound around a driving roller 54, a secondary transfer counter roller 52, and a driven roller 53 as a plurality of support members.

On the inner circumferential surface side of the intermediate transfer belt 5, four primary transfer rollers 8 are provided as a primary transfer portion side by side so that they face respective photosensitive drums 1. The primary transfer roller 8 presses the intermediate transfer belt 5 against the photosensitive drum 1 to form a primary transfer portion N1 in which the intermediate transfer belt 5 comes in contact with the photosensitive drum 1. Then, a bias having a polarity opposite to the normal charging polarity of the toner is applied to the primary transfer roller 8 from a primary transfer bias power supply (high voltage power supply) as a primary transfer bias application portion. Therefore, the toner image on the photosensitive drum 1 is transferred (primary transfer) onto the intermediate transfer belt 5.

In addition, on the outer circumferential surface side of the intermediate transfer belt 5, a secondary transfer roller 9 as a secondary transfer portion is disposed at a position at which it faces the secondary transfer counter roller 52. The secondary transfer roller 9 is pressed against the secondary transfer counter roller 52 via the intermediate transfer belt 5 to form a secondary transfer portion N2 in which the intermediate transfer belt 5 comes in contact with the secondary transfer roller 9. Then, a bias having a polarity opposite to normal charging polarity of the toner is applied to the secondary transfer roller 9 from a secondary transfer bias power supply (high voltage power supply) as a secondary transfer bias application portion. Thereby, the toner image on the intermediate transfer belt 5 is transferred (secondary transfer) to the recording member 12.

More specifically, when an image is formed, first, the surface of the photosensitive drum 1 is uniformly charged by the charging roller 2. Next, the surface of the charged photosensitive drum 1 is scanned and exposed with a laser beam corresponding to image information emitted from the scanner unit 3, and an electrostatic image according to the image information is formed on the photosensitive drum 1.

Next, the electrostatic image formed on the photosensitive drum 1 is developed as a toner image by the development unit 4. The toner image formed on the photosensitive drum 1 is transferred (primary transfer) onto the intermediate transfer belt 5 due to the action of the primary transfer roller 8.

For example, when a full-color image is formed, the above processes are sequentially performed in the first to fourth image forming portions SY, SM, SC, and SK, and toner images of respective colors are next superimposed on the intermediate transfer belt 5 and primarily transferred. Then, the recording member 12 is conveyed to the secondary transfer portion N2 in synchronization with movement of the intermediate transfer belt 5. Four color toner images on the intermediate transfer belt 5 are secondarily-transferred onto the recording member 12 together due to the action of the secondary transfer roller 9 in contact with the intermediate transfer belt 5 via the recording member 12. The recording member 12 onto which the toner image has been transferred is conveyed to a fixing apparatus 10 as a fixing portion. In the fixing apparatus 10, heat and pressure are applied to the recording member 12, and thus the toner image is fixed to the recording member 12. The recording member 12 on which the toner image is fixed is conveyed further downstream from the fixing apparatus 10, and discharged outside the apparatus.

After a primary transfer step, the primary residual transfer toner remaining on the photosensitive drum 1 is removed and collected by the cleaning member 6. In addition, after a secondary transfer step, the secondary residual transfer toner remaining on the intermediate transfer belt 5 is cleaned by an intermediate transfer belt cleaning apparatus 11. Here, the image forming apparatus 100 can form a monochromatic or multi-color image using only one desired image forming portion or using only some (not all) of the image forming portion.

Schematic Configuration of Process Cartridge

Figure 2:
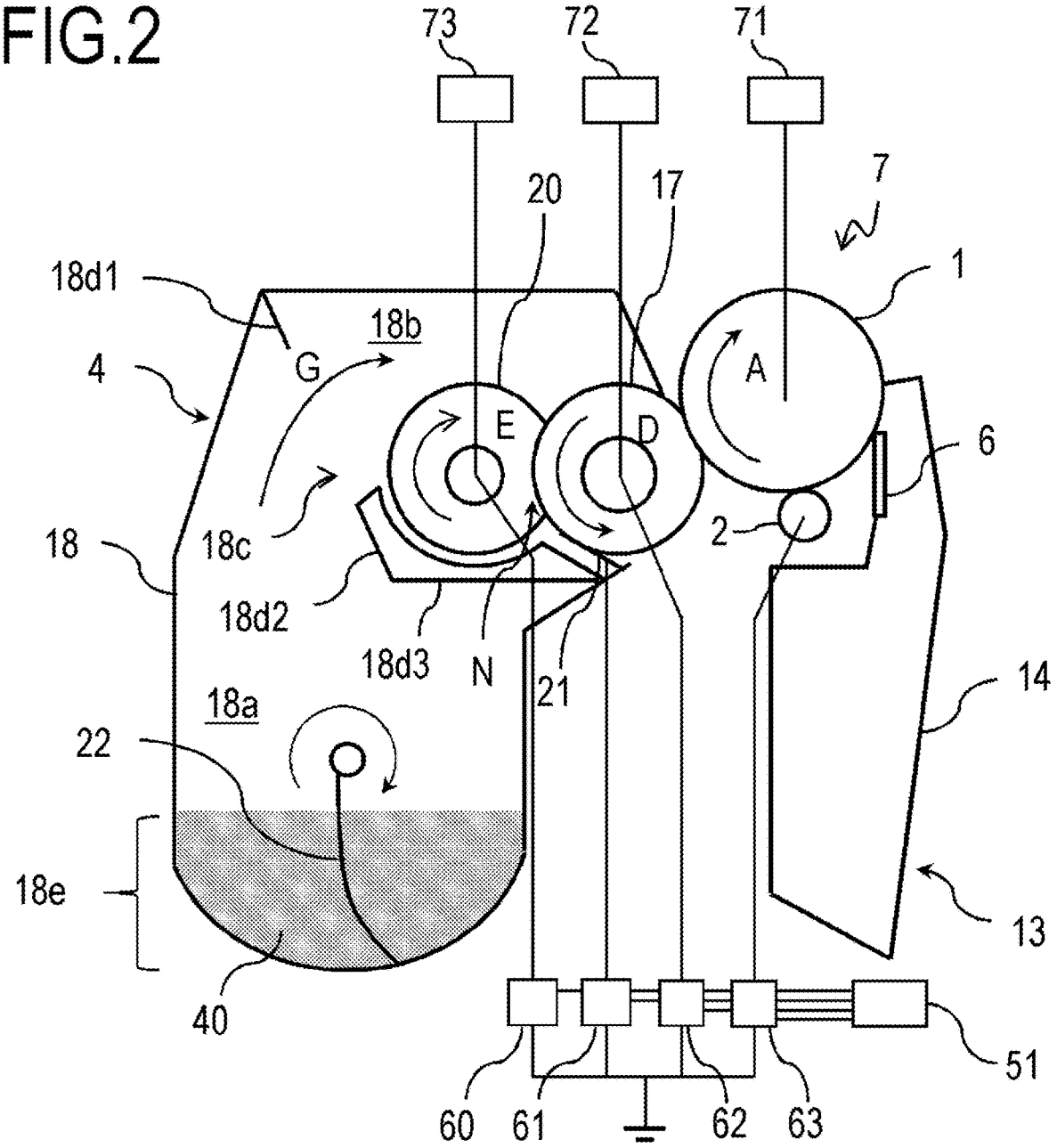
FIG. 2 is a schematic cross-sectional view of a process cartridge.

The overall configuration of the process cartridge 7 mounted on the image forming apparatus 100 of the present embodiment will be described with reference to FIG. 2. In the present embodiment, except for the type (color) of the stored toner, the configurations and operations of the process cartridges 7 for respective colors are substantially the same. FIG. 2 is a schematic cross-sectional view (main cross-sectional view) of the process cartridge 7 of this example when viewed in the longitudinal direction (rotation axis direction) of the photosensitive drum 1. The orientation of the process cartridge 7 in FIG. 2 is an orientation (orientation during use) when it is mounted in the image forming apparatus main body, and when the positional relationship, direction, and the like of respective members of the process cartridges are described below, the positional relationship and direction in this orientation and the like are shown. That is, in FIG. 2, the up to down direction in the drawing corresponds to the vertical direction, and the left to right direction in the drawing corresponds to the horizontal direction. Here, this disposition configuration is set on the assumption that the image forming apparatus is installed on a horizontal plane in a normal installation state.

The process cartridge 7 is configured by integrating a photosensitive member unit 13 including the photosensitive drum 1 and the like and the development unit 4 including a developing roller 17 and the like. The photosensitive member unit 13 has a cleaning frame body 14 as a frame body that supports various elements in the photosensitive member unit 13. The photosensitive drum 1 is rotatably attached to the cleaning frame body 14 via a bearing (not shown). The photosensitive drum 1 is driven to rotate in a direction (clockwise) indicated by the arrow A in the drawing according to an image forming operation when a driving force of a drive motor as a drive portion (driving source) is transmitted to the photosensitive member unit 13. In addition, the cleaning member 6 and the charging roller 2 are disposed in the photosensitive member unit 13 so that they come in contact with the circumferential surface of the photosensitive drum 1. The residual transfer toner removed from the surface of the photosensitive drum 1 by the cleaning member 6 falls into and is stored in the cleaning frame body 14.

The charging roller 2 as a charging portion is driven to rotate by bringing a roller part of the conductive rubber into pressure-contact with the photosensitive drum 1.

Here, in the metal core of the charging roller 2, in a charging step, a predetermined voltage as a charging bias is applied from a charging bias power supply (high voltage power supply) 63 as a charging bias application portion (charging voltage application portion). Thereby, a predetermined DC voltage is applied to the photosensitive drum 1, and a uniform dark portion potential (Vd) is formed on the surface of the photosensitive drum 1. The photosensitive drum 1 is exposed with a spot pattern of a laser beam emitted according to image data by a laser beam from the above scanner unit 3, and in the exposed segment, charge on the surface disappears due to the carrier from the carrier generation layer, and the potential decreases. As a result, an electrostatic latent image of a predetermined bright portion potential (Vl) in the exposed segment and an electrostatic latent image of a predetermined dark portion potential (Vd) in the unexposed segment are formed on the photosensitive drum 1. In the present invention, Vd=−500 V, and Vl=−100 V. In the present embodiment, the configuration related to formation of an electrostatic latent image (development contrast), that is, the charging roller 2, the charging bias power supply 63, the scanner unit 3, and the like correspond to a latent image forming portion of the present invention.

Meanwhile, the development unit 4 includes the developing roller 17, a development blade 21, a toner supply roller 20, and a stirring transport member 22. The developing roller 17 carries a toner 40 as a developing agent carrying member. The development blade 21 as a regulating member regulates (the layer thickness of) the toner 40 carried on the developing roller 17. The toner supply roller 20 as a developing agent supply member supplies the toner 40 to the developing roller 17. The stirring transport member 22 as a transport member conveys the toner 40 to the toner supply roller 20. The development unit 4 has a developing frame body (developing container) 18 to which the developing roller 17, the toner supply roller 20, and the stirring transport member 22 are rotatably assembled. The developing frame body 18 includes a toner storage chamber **18*a* in which the stirring transport member 22 is disposed, a developing chamber 18*b* in which the developing roller 17 and the toner supply roller 20 are disposed, and a communication port 18*c* that connects the toner storage chamber 18*a* to the developing chamber 18*b* so that the toner 40 can move. The communication port 18*c* is provided in a partition wall 18*d* (18*d*1 to 18*d*3) that partitions the toner storage chamber 18*a* and the developing chamber 18*b***. Here, the material of the regulating member is preferably stainless steel.

The partition wall **18*d* partitions the internal space of the developing frame body 18 into the toner storage chamber 18*a* and the developing chamber 18*b*. The partition wall 18*d* includes the first wall 18*d*1 that partitions the internal space of the developing frame body 18 above the communication port 18***c*, the second wall 18*d*2 that partitions below the communication port 18*c*, and the third wall 18*d*3 that is connected to the second wall 18*d*2 and partitions below the toner supply roller 20 and the developing roller 17. The first wall 18*dl* and the second wall 18*d*2 extend in a direction inclined with respect to the vertical direction so that an opening direction from the toner storage chamber 18*a* of the communication port 18*c* toward the developing chamber 18*b* is directed upward from the horizontal direction. The communication port 18*c* opens in a region on the side opposite to the developing roller 17 with respect to the toner supply roller 20 in the partition wall 18*d* so that it faces a space above the toner supply roller 20 in the developing chamber 18*b*. Thereby, the internal space of the developing chamber 18*b* extends in the horizontal direction as it goes upward, and the communication port 18*c* easily receives the toner 40 pumped up by the stirring transport member 22 toward the upper side from the lower side of the toner storage chamber 18*a*. The third wall 18*d*3 extends from the lower end of the second wall 18*d*2 below the toner supply roller 20 and the developing roller 17 in a substantially horizontal direction. The third wall 18*d*3 and the second wall 18*d*2 form a configuration (storage tank for the toner 40) in which the toner 40 spilled from the toner supply roller 20 and the developing roller 17 out of the toner 40 that has passed through the communication port 18*c* is received. The configuration including the second wall 18*d*2 and the third wall 18*d*3 is formed from one side surface to the other side surface of the developing frame body 18 in the longitudinal direction (in a direction along the rotation axis of the developing roller 17 or the toner supply roller 20).

Here, in the internal space of the developing chamber 18*b*, an open space region in which the circumferential surfaces of the toner supply roller 20 and the developing roller 17 above the nip portion N face the inner wall surface of the developing chamber 18*b* is formed. The space region is surrounded by a region above the nip portion N of the circumferential surfaces of the toner supply roller 20 and the developing roller 17, the inner wall surface of the developing chamber 18*b* that faces them, and both sides of the developing chamber 18*b* in the longitudinal direction.

Below the nip portion N in the internal space of the developing chamber 18*b*, a narrow space region in which the toner supply roller 20, the developing roller 17 and the development blade 21, and the second wall 18*d*2 and the third wall 18*d*3 face each other with a predetermined interval therebetween is formed. The space region is surrounded by the second wall 18*d*2 and the third wall 18*d*3, the circumferential surface region of the toner supply roller 20 and the developing roller 17 that face them, the development blade 21, and both sides of the developing chamber 18*b* in the longitudinal direction.

Figure 6:
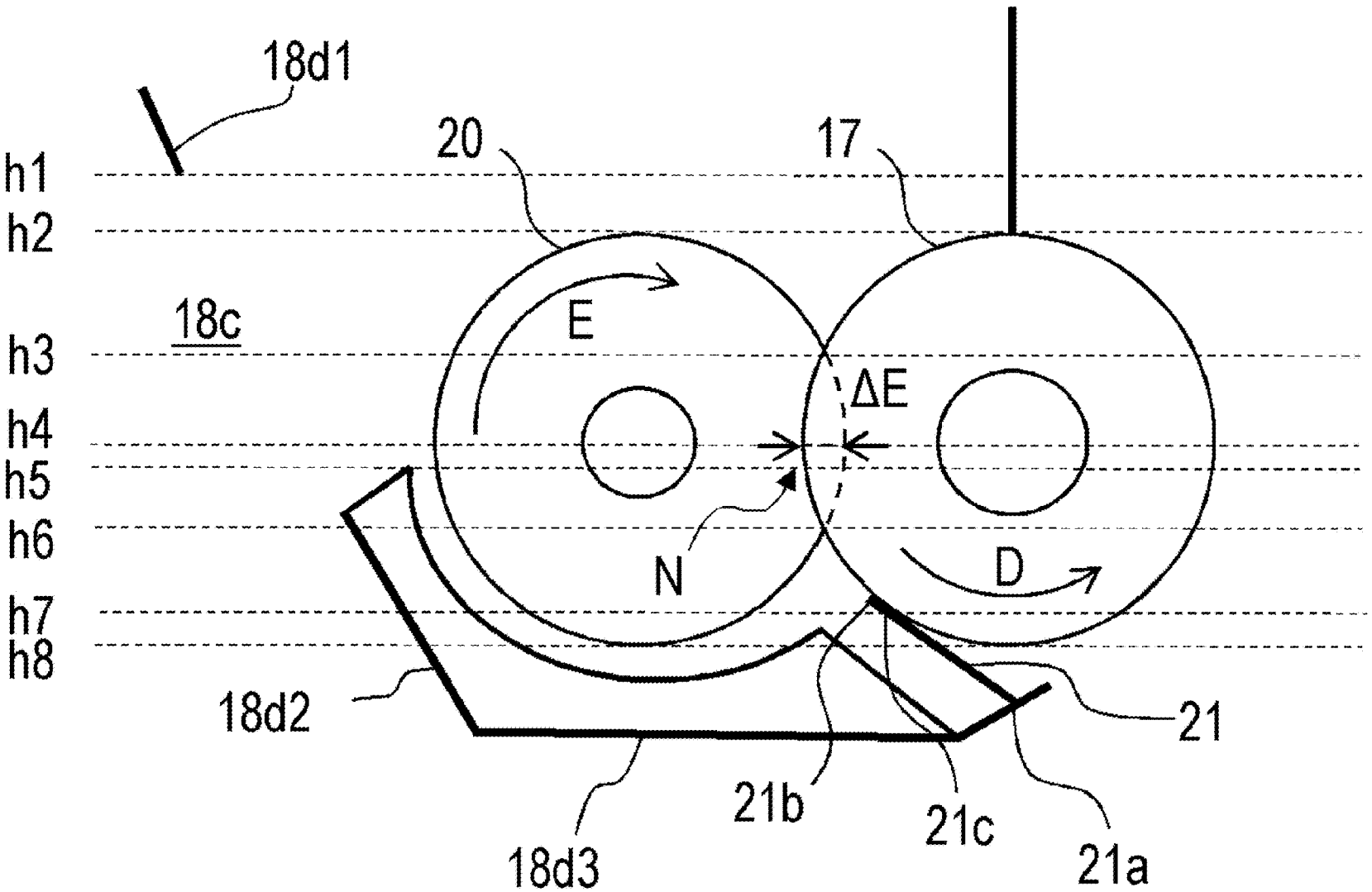
FIG. 6 is an explanatory diagram of a disposition configuration of a process cartridge.

A disposition configuration of members in the developing chamber 18*b* of this example will be described in detail with reference to FIG. 6. FIG. 6 is a schematic cross-sectional view illustrating the disposition relationship of members in the development device according to this example.

In this example, (i) the upper end of the communication port 18*c* (the boundary of the communication port 18*c* in the first wall 18*dl*) that separates the developing chamber 18*b* and the toner storage chamber 18*a* is disposed above the upper end of the toner supply roller 20. That is, as shown in FIG. 6, a horizontal line h1 that passes through the upper end of the communication port 18*c* is positioned above a horizontal line h2 that passes through the upper end of the toner supply roller 20.

In addition, (ii) the center of the nip portion N (the central part in the height direction or the position intersecting a line connecting the toner supply roller 20 to the rotation center of the developing roller 17) is disposed above the lower end of the communication port 18*c* and the lower end of the nip portion N is disposed below the lower end of the communication port 18*c*. That is, as shown in FIG. 6, a horizontal line h4 that passes through the center of the nip portion N is positioned above a horizontal line h5 that passes through the lower end of the communication port 18*c* (the upper end of the second wall 18*d*2 (the boundary of the communication port 18*c* in the second wall 18*d*2)). In addition, a horizontal line h6 that passes through the lower end of the nip portion N is positioned below the horizontal line h5 that passes through the lower end of the communication port 18*c*.

In addition, (iii) the lower end of the communication port 18*c* (the upper end of the second wall 18*d*2) is disposed above an end 21*b* on the upstream side in the rotation direction of the developing roller 17 at a contact position 21*c* between the development blade 21 and the developing roller 17. That is, as shown in FIG. 6, the horizontal line h5 that passes through the lower end of the communication port 18*c* (the upper end of the second wall 18*d*2) is positioned above a horizontal line h7 that passes through the contact position 21*c* between the development blade 21 and the developing roller 17.

(iv) The lower end of the communication port 18*c* is disposed above the lower end of the toner supply roller 20. That is, as shown in FIG. 6, the horizontal line h5 that passes through the lower end of the communication port 18*c* (the upper end of the second wall 18*d*2) is positioned above a horizontal line h8 that passes through the lower end of the toner supply roller 20.

The operations and effects of disposition configurations (i) to (iv) will be described below.

(i) Disposition Relationship Between Upper End of Communication Port 18*c* and Upper End of Toner Supply Roller 20

As described above, main toner supply to the toner supply roller 20 is performed by pumping up the toner 40 by the stirring transport member 22, and directly supplying it to a space above the nip portion N. In this example, since the upper end of the communication port 18*c* is disposed above the upper end of the toner supply roller 20, the toner 40 can be supplied to a suction port of the toner supply roller 20 above (first space of) the nip portion N over the toner supply roller 20. When the upper end of the communication port 18*c* is disposed below the upper end of the toner supply roller 20, since the upper end of the communication port 18*c* blocks a toner supply path, it is difficult to directly supply the toner to the space above the nip portion N by the stirring transport member 22.

(ii) Disposition Relationship Between Center (Central Part in Height Direction) of Nip Portion N and Lower End of Communication Port 18*c*

When the lower end of the communication port 18*c* is above the center position (the height of the central part in the height direction) of the nip portion N, the height of the surface of the toner agent received by the second wall 18*d*2 and the third wall 18*d*3 in the developing chamber 18*b* are beyond the center of the nip portion N. In such a disposition, the toner 40 easily enters the nip portion N, a mechanical stripping force of the toner supply roller 20 with respect to the toner 40 remaining on the developing roller 17 after a developing operation becomes weak, and development streaks due to insufficient stripping are more likely to occur. Therefore, the position of the lower end of the communication port 18*c* needs to be provided at least below the upper end of the nip portion N. That is, as shown in FIG. 6, the horizontal line h5 that passes through the lower end of the communication port 18*c* is positioned below a horizontal line h3 that passes through the upper end of the nip portion N. In addition, when the lower end of the communication port 18*c* is disposed below the center position of the nip portion N, this is desirable since the stripping performance of the toner supply roller 20 can be improved.

(iii) Disposition Relationship Between Lower End of Communication Port 18*c* and Tip of Development Blade 21

The lower end of the communication port 18*c* is disposed at the same position as or above the end 21*b* on the upstream side in the rotation direction of the developing roller 17 at the contact position 21*c* between the development blade 21 and the developing roller 17. Accordingly, the excess toner 40 regulated by the development blade 21 is continuously supplied to a narrow space between the second wall 18*d*2, the third wall 18*d*3, and the toner supply roller 20. Accordingly, a pressure density of the toner 40 in the narrow space is further increased, and supply of the toner from the narrow space to the toner supply roller 20 and a flow of the toner 40 that returns to the toner storage chamber 18*a* from the narrow space over the lower end wall of the communication port 18*c* can be formed.

(iv) Disposition Relationship Between Lower End of Communication Port 18*c* and Toner Supply Roller 20

In addition, in the configuration of this example, the lower end of the communication port 18*c* is disposed above the lower end of the toner supply roller 20. Accordingly, an amount of the toner returning from the narrow space to the toner storage chamber 18*a* can be controlled such that it is an appropriate amount, and thus a suitable consolidation space can be formed in the narrow space.

In the developing chamber 18*b*, a development opening is provided as an opening through which the toner 40 moves to the outside of the developing frame body 18, and the developing roller 17 is rotatably assembled to the developing frame body 18 in a disposition in which the development opening is blocked. That is, the toner 40 stored in the developing frame body 18 is carried and conveyed by the developing roller 17 that rotates and passes through the development opening and moves to the outside of the developing frame body 18, and develops an electrostatic latent image on the photosensitive drum 1. In this case, an amount of the toner moved to the outside of the developing frame body 18 is regulated and adjusted by the development blade 21. The toner storage chamber 18*a* is positioned below the developing chamber 18*b* in the direction of gravity. The position at which the development blade 21 comes in contact with the developing roller 17 is a position below the rotation center of the developing roller 17 and between the rotation center of the developing roller 17 and the rotation center of the toner supply roller 20 in the horizontal direction.

As shown in FIG. 2, in the toner storage chamber 18*a*, a toner container (developing agent container) 18*e*, which is a region in which the toner 40 mainly stays in a statically accumulated state rather than a state in which the toner 40 is scattered due to, for example, stirring of the stirring transport member 22, is a region below the toner storage chamber 18*a*. In this example, the toner container 18*e* of the toner storage chamber 18*a* is positioned below the toner supply roller 20 in a direction of gravity (vertical direction).

The stirring transport member 22 stirs the toner stored in the toner storage chamber 18 and conveys the toner in a direction indicated by the arrow G in the drawing upward the toner supply roller 20. In the present embodiment, the stirring transport member is driven to rotate at 60 rpm (revolutions per minute: represents the number of rotations per minute (unit time)).

Directions in which the developing roller 17 and the photosensitive drum 1 rotate are opposite to each other. That is, they rotate so that surfaces thereof move in the same direction (in the present embodiment, the direction from the bottom to the top) in both opposing parts. Here, in this example, the developing roller 17 is disposed in contact with the photosensitive drum 1. However, the developing roller 17 may be disposed close to the photosensitive drum 1 at a predetermined interval therefrom.

A predetermined DC bias (developing bias) sufficient to develop and visualize the electrostatic latent image on the photosensitive drum 1 as a toner image (developing agent image) is applied to the developing roller 17 from a developing bias power supply (high voltage power supply) 62 as a developing bias application portion (a development voltage application portion). According to the developing bias applied to the developing roller 17, the toner negatively charged by frictional charging is moved only to a bright portion potential part and an electrostatic latent image is visualized according to a potential difference from the developing bias in a development nip portion that comes in contact with the photosensitive drum 1. In the present embodiment, the developing bias is −300 V. A potential difference $\Delta V=200$ V from the bright portion potential part is formed to form a toner image.

The toner supply roller 20 and the developing roller 17 rotate so that surfaces thereof move from the upper end to the lower end of the nip portion N. That is, the toner supply roller 20 rotates in a direction indicated by the arrow E in the drawing (clockwise direction), and the developing roller 17 rotates in a direction indicated by the arrow D (counterclockwise direction). The toner supply roller 20 is an elastic sponge roller in which a foam layer is formed on the outer circumference of a conductive metal core. The toner supply roller 20 and the developing roller 17 are in contact with each other with a predetermined penetration amount (dent amount) $\Delta E$. Here, directions in which the toner supply roller 20 and the developing roller 17 rotate may be the same direction so that the surfaces thereof move in opposite directions.

Here, as shown in FIG. 6, a penetration amount $\Delta E$ is defined as an amount of overlap when the developing roller 17 and the toner supply roller 20 virtually overlap when no deformation due to contact occurs when viewed in a rotation axis direction of the developing roller 17 or the toner supply roller 20. Specifically, as shown in FIG. 6, when viewed in the rotation axis direction, the length of a line segment connecting one point on the outer circumference of the developing roller 17 that has entered furthest with respect to the toner supply roller 20 and one point on the outer circumference of the toner supply roller 20 that has entered furthest with respect to the developing roller 17 is set as a penetration amount $\Delta E$. Alternatively, when viewed in the rotation axis direction, in an overlapping part in which the toner supply roller 20 and the developing roller 17 virtually overlap, the length of a line segment region that intersects a line connecting rotation centers of the toner supply roller 20 and the developing roller 17 is set as the penetration amount $\Delta E$.

The toner supply roller 20 and the developing roller 17 rotate with a peripheral speed difference in the same direction in the nip portion N, and according to this operation, the toner is supplied to the developing roller 17 by the toner supply roller 20. In this case, when a predetermined supply bias (Vr) is applied to the toner supply roller 20 from a supply bias power supply (high voltage power supply) 60 as a supply bias application portion (a supply voltage application portion), a potential difference (ΔVr) between the toner supply roller 20 and the developing roller 17 can be adjusted. When the potential difference is adjusted, an amount of the toner supplied to the developing roller 17 can be adjusted.

Here, in the present embodiment, the developing roller 17 and the toner supply roller 20 both have an outer diameter of 15 mm. In addition, a penetration amount, of the toner supply roller 20 into the developing roller 17, that is, a dent amount ΔE in which the toner supply roller 20 is recessed by the developing roller 17 is set to 1.0 mm. In addition, the toner supply roller 20 and the developing roller 17 are disposed so that their center heights are substantially the same.

The development blade 21 is disposed in a counter direction with respect to rotation of the developing roller 17 and is a member that regulates an amount of the toner carried on the developing roller 17. In addition, the toner 40 is frictionally charged by peripheral friction between the development blade 21 and the developing roller 17 and an electric charge is imparted, and at the same time, the layer thickness is regulated. In the development blade 21, one end 21*a* in the short side direction perpendicular to the longitudinal direction is fixed to the developing frame body 18 by a fastener such as a screw, and the other end 21*b* is a free end. A direction in which the development blade 21 extends from the one end 21*a* fixed to the developing frame body 18 to the other end 21*b* in contact with the developing roller 17 is opposite (counter direction) to the rotation direction of the developing roller 17 in a portion in contact with the developing roller 17.

In the present embodiment, regarding the development blade 21, a leaf spring-like thin plate made of SUS having a free length in the short side direction of 8 mm and a thickness of 0.08 mm is used. Here, the development blade is not limited thereto, and a metal thin plate made of phosphor bronze, aluminum, or the like may be used. In addition, the development blade 21 of which the surface is covered with a thin film of such as a polyamide elastomer, a urethane rubber, a urethane resin or the like may be used. In addition, a predetermined voltage as a blade bias (Vb) is applied from a blade bias power supply (high voltage power supply) 61 as a regulatory bias application portion (a regulatory voltage application portion) to the development blade 21.

Here, various biases applied by various power supplies including the supply bias power supply 60, the blade bias power supply 61, the developing bias power supply 62, and the charging bias power supply 63 are controlled by the CPU 51 which is a control portion.

Motor drive portions 71, 72, and 73 for driving the photosensitive drum 1, the developing roller 17, and the toner supply roller 20, respectively, and a motor drive portion (not shown) for driving the stirring transport member 22 are composed of respective motors (power sources, not shown) and a gear train that transmits a rotational driving force of the motor. The motor drive portions 71 to 73 and the like correspond to drive portions that can drive the image bearing member, the developing agent carrying member, the supply member, and the transport member in the present invention so that they variably rotate individually and are controlled by the CPU 51. The photosensitive drum 1, the developing roller 17, and the toner supply roller 20 are driven to rotate at a predetermined peripheral speed (a distance that one point on the outer circumferential surface moves per unit time).

Photosensitive Drum

In the embodiment of the present invention, in the photosensitive drum 1 which is the center for the image forming process, an undercoat layer is formed on a support, a charge generation layer is formed on the undercoat layer, a charge transport layer is formed on the charge generation layer, and a protective layer is formed on the charge transport layer. The protective layer is preferably the outermost surface layer.

Examples of a method of producing the photosensitive drum include a method of preparing a coating solution for each layer to be described below and applying it to desired layers in order, and performing drying. In this case, examples of a method of applying a coating solution include immersion coating, spray coating, inkjet coating, roll coating, die coating, blade coating, curtain coating, wire bar coating, and ring coating. Among these, in consideration of efficiency and productivity, immersion coating is preferable.

Support

In the embodiment, the photosensitive drum (electrophotographic photosensitive member) includes a support. The support is preferably a conductive support having conductivity. In addition, examples of the shape of the support include a cylindrical shape, a belt shape, and a sheet shape. Among these, a cylindrical support is preferable. In addition, the surface of the support may be subjected to an electrochemical treatment such as anodization, a blast treatment, a cutting treatment, or the like. Regarding the material of the support, a metal, a resin, glass, or the like is preferable.

Examples of metals include aluminum, iron, nickel, copper, gold, stainless steel, and alloys thereof. Among these, an aluminum support using aluminum is preferable.

In addition, conductivity may be imparted to the resin or glass according to a treatment such as mixing in or applying conductive materials.

In addition, the conductive layer may be provided on the support. When the conductive layer is provided, it is possible to conceal scratches and unevennesses on the surface of the support and control reflection of light on the surface of the support. The conductive layer preferably includes conductive particles and a resin. Examples of materials of conductive particles include a metal oxide, a metal, and carbon black.

Examples of metal oxides include zinc oxide, aluminum oxide, indium oxide, silicon oxide, zirconium oxide, tin oxide, titanium oxide, magnesium oxide, antimony oxide, and bismuth oxide. Examples of metals include aluminum, nickel, iron, nichrome, copper, zinc, and silver. Among these, regarding conductive particles, a metal oxide is preferably used, and in particular, titanium oxide, tin oxide, or zinc oxide is more preferably used.

When a metal oxide is used as conductive particles, the surface of the metal oxide may be treated using a silane coupling agent, or an element such as phosphorus and aluminum or an oxide thereof may be doped into the metal oxide.

In addition, conductive particles may have a structure in which core material particles and a coat layer that covers the particles are laminated. Examples of core material particles include titanium oxide, barium sulfate, and zinc oxide. Examples of coat layers include layers of a metal oxide such as tin oxide.

In addition, when a metal oxide is used as conductive particles, the volume-average particle diameter is preferably at least 1 nm and not more than 500 nm and more preferably at least 3 nm and not more than 400 nm.

Examples of resins include a polyester resin, a polycarbonate resin, a polyvinyl acetal resin, an acrylic resin, a silicone resin, an epoxy resin, a melamine resin, a polyurethane resin, a phenolic resin, and an alkyd resin.

In addition, the conductive layer may further contain a masking agent such as silicone oil, resin particles, and titanium oxide.

The average film thickness of the conductive layer is preferably at least 1 μm and not more than 50 μm and particularly preferably at least 3 μm and not more than 40 μm.

The conductive layer can be formed by preparing a coating solution for a conductive layer containing the above materials and solvent, and forming the coating, and drying it. Examples of solvents used in the coating solution include an alcohol solvent, a sulfoxide solvent, a ketone solvent, an ether solvent, an ester solvent, and an aromatic hydrocarbon solvent. Examples of a dispersion method for dispersing conductive particles in the coating solution for a conductive layer include methods using a paint shaker, a sand mill, a ball mill, and a liquid collision type high-speed disperser.

Undercoat Layer

The undercoat layer is provided on the support or the conductive layer. When the undercoat layer is provided, an adhesive function between layers can be improved and a charge injection blocking function can be imparted.

The undercoat layer preferably contains a resin. In addition, a composition containing a monomer having a polymerizable functional group may be polymerized to form an undercoat layer as a cured film.

Examples of resins include a polyester resin, a polycarbonate resin, a polyvinyl acetal resin, an acrylic resin, an epoxy resin, a melamine resin, a polyurethane resin, a phenolic resin, a polyvinyl phenolic resin, an alkyd resin, a polyvinyl alcohol resin, a polyethylene oxide resin, a polypropylene oxide resin, a polyamide resin, a polyamic acid resin, a polyimide resin, a polyamideimide resin, and a cellulose resin.

Examples of polymerizable functional groups that the monomer having a polymerizable functional group has include an isocyanate group, a block isocyanate group, a methylol group, an alkylated methylol group, an epoxy group, a metal alkoxide group, a hydroxyl group, an amino group, a carboxyl group, a thiol group, a carboxylic anhydride group, and a carbon-carbon double bond group.

In addition, the undercoat layer may further contain an electron transport substance, a metal oxide, a metal, a conductive polymer or the like in order to improve electrical characteristics. Among these, an electron transport substance or a metal oxide is preferably used.

Examples of electron transport substances include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron transport substance having a polymerizable functional group is used as an electron transport substance and is copolymerized with the above monomer having a polymerizable functional group and thereby an undercoat layer as a cured film may be formed.

Examples of metal oxides include indium tin oxide, tin oxide, indium oxide, titanium oxide, zinc oxide, aluminum oxide, and silicon dioxide. Examples of metals include gold, silver, and aluminum.

In addition, the undercoat layer may further contain additives.

The average film thickness of the undercoat layer is preferably at least 0.1 μm and not more than 50 μm, more preferably at least 0.2 μm and not more than 40 μm, and particularly preferably at least 0.3 μm and not more than 30 μm.

The undercoat layer can be formed by preparing a coating solution for an undercoat layer containing the above materials and solvent and forming the coating, and drying and/or curing it. Examples of solvents used in the coating solution include an alcohol solvent, a ketone solvent, an ether solvent, an ester solvent, and an aromatic hydrocarbon solvent.

Charge Generation Layer

The charge generation layer preferably contains a charge generating substance and a resin. Examples of charge generating substances include an azo pigment, a perylene pigment, a polycyclic quinone pigment, an indigo pigment, and a phthalocyanine pigment. Among these, an azo pigment or a phthalocyanine pigment is preferable. Among phthalocyanine pigments, an oxytitanium phthalocyanine pigment, a chlorogallium phthalocyanine pigment, or a hydroxygallium phthalocyanine pigment is preferable.

The content (mass %) of the charge generating substance in the charge generation layer is preferably at least 40 mass % and not more than 85 mass % and more preferably at least 60 mass % and not more than 80 mass % with respect to the total mass of the charge generation layer.

Examples of resins include a polyester resin, a polycarbonate resin, a polyvinyl acetal resin, a polyvinyl butyral resin, an acrylic resin, a silicone resin, an epoxy resin, a melamine resin, a polyurethane resin, a phenolic resin, a polyvinyl alcohol resin, a cellulose resin, a polystyrene resin, a polyvinyl acetate resin, and a polyvinyl chloride resin. Among these, a polyvinyl butyral resin is more preferable.

In addition, the charge generation layer may further contain additives such as an antioxidant and a UV absorber. Specifically, a hindered phenolic compound, a hindered amine compound, a sulfur compound, a phosphorus compound, a benzophenone compound, and the like may be exemplified.

The average film thickness of the charge generation layer is preferably at least 0.1 μm and not more than 1 μm and more preferably at least 0.15 μm and not more than 0.4 μm.

The charge generation layer can be formed by preparing a coating solution for a charge generation layer containing the above materials and solvent, forming the coating, and drying it. Examples of solvents used in the coating solution include an alcohol solvent, a sulfoxide solvent, a ketone solvent, an ether solvent, an ester solvent, and an aromatic hydrocarbon solvent.

Charge Transport Layer

The charge transport layer preferably contains a charge transport substance and a resin. Examples of charge transport substances include a polycyclic aromatic compound, a heterocyclic compound, a hydrazone compound, a styryl compound, an enamine compound, a benzidine compound, a triarylamine compound, and resins having groups derived from these substances. Among these, a triarylamine compound or a benzidine compound is preferable.

The content of the charge transport substance in the charge transport layer is preferably at least 25 mass % and not more than 70 mass % and more preferably at least 30 mass % and not more than 55 mass % with respect to the total mass of the charge transport layer.

Examples of resins include a polyester resin, a polycarbonate resin, an acrylic resin, and a polystyrene resin. Among these, a polycarbonate resin and a polyester resin are preferable. Regarding the polyester resin, particularly, a polyarylate resin is preferable.

A content ratio (mass ratio) between the charge transport substance and the resin is preferably 4:10 to 20:10 and more preferably 5:10 to 12:10.

In addition, the charge transport layer may contain additives such as an antioxidant, a UV absorber, a plasticizer, a leveling agent, a slip-imparting agent, and a wear resistance improving agent. Specifically, a hindered phenolic compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, boron nitride particles, and the like may be exemplified.

The average film thickness of the charge transport layer is preferably at least 5 μm and not more than 50 μm, more preferably at least 8 μm and not more than 40 μm, and particularly preferably at least 10 μm and not more than 30 μm. In the embodiment of the present invention, the average film thickness is 12 μm.

The charge transport layer can be formed by preparing a coating solution for a charge transport layer containing the above materials and solvent, forming the coating, and drying it. Examples of solvents used in the coating solution include an alcohol solvent, a ketone solvent, an ether solvent, an ester solvent, and an aromatic hydrocarbon solvent. Among these solvents, an ether solvent or an aromatic hydrocarbon solvent is preferable.

Here, in the embodiment of the present invention, a lamination type photosensitive member including the charge generation layer and the charge transport layer is used. However, a single layer type photosensitive member containing both a charge generating substance and a charge transport substance may be used. The single layer type photosensitive member can be formed by preparing a coating solution for a photosensitive layer containing a charge generating substance, a charge transport substance, a resin, and a solvent, forming the coating, and drying it. The charge generating substance, the charge transport substance, and the resin are the same as those exemplified for materials in the lamination type photosensitive member.

Protective Layer

In order to improve wear resistance, in the photosensitive drum 1 has a wear-resistant protective layer on the outermost layer. When the protective layer is provided, it is possible to improve durability.

The protective layer preferably contains conductive particles and/or a charge transport substance, and a resin.

Examples of conductive particles include particles of a metal oxide such as titanium oxide, zinc oxide, tin oxide, and indium oxide.

Examples of charge transport substances include a polycyclic aromatic compound, a heterocyclic compound, a hydrazone compound, a styryl compound, an enamine compound, a benzidine compound, and a triarylamine compound, and a resin having a group derived from such substances. Among these, a triarylamine compound or a benzidine compound is preferable.

Examples of resins include a polyester resin, an acrylic resin, a phenoxy resin, a polycarbonate resin, a polystyrene resin, a phenolic resin, a melamine resin, and an epoxy resin. Among these, a polycarbonate resin, a polyester resin, and an acrylic resin are preferable.

In addition, the protective layer may be formed as a cured film by polymerizing a composition containing a monomer having a polymerizable functional group. Examples of reactions at that time include a thermal polymerization reaction, a photopolymerization reaction, and a radiation polymerization reaction. Examples of polymerizable functional groups that the monomer having a polymerizable functional group has include an acrylic group and a methacrylic group. Regarding the monomer having a polymerizable functional group, a material having a charge transport ability may be used.

The protective layer may contain additives such as an antioxidant, a UV absorber, a plasticizer, a leveling agent, a slip-imparting agent, and a wear resistance improving agent. Specific examples thereof include a hindered phenolic compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average film thickness of the protective layer is preferably at least 0.5 μm and not more than 10 μm and more preferably at least 1 μm and not more than 7 μm.

The protective layer can be formed by preparing a coating solution for a protective layer containing the above materials and solvent, forming the coating, and drying and/or curing it. Examples of solvents used in the coating solution include an alcohol solvent, a ketone solvent, an ether solvent, a sulfoxide solvent, an ester solvent, and an aromatic hydrocarbon solvent.

In the embodiment of the present invention, the average film thickness of the protective layer was 3 μm.

In order to check durability of the photosensitive drum 1, the drum film thickness after 200.000 sheets were continuously passed at a 1% print percentage was measured, and the amount of scraping of the drum was measured.

The amount of scraping of the drum film thickness of the photosensitive drum 1 was checked, and found to be 0.001 um per 1,000 sheets. The amount of scraping was 0.2 um on 200,000 sheets, and there were no leaks or fogging caused by drum scraping.

Meanwhile, when the same continuous passing of sheets was performed on the photosensitive drum in which the charge transport layer increased by 3 um instead of providing a protective layer to the photosensitive drum 1, all of the charge transport layer of the photosensitive drum was scraped at the time corresponding to 75,000 sheets. In addition, at this time, when the amount of scraping was measured, it was 0.2 um per 1,000 sheets.

This means that the durability was increased 200 times using the photosensitive drum 1 having a protective layer.

In the embodiment of the present invention, in order to reduce wearing of the photosensitive drum 1, a photosensitive drum having a protective layer was used. However, a method of reducing wearing of the photosensitive drum 1 is not limited thereto. For example, a selenium drum, an amorphous silicon drum, and the like may be used. In addition, a contact pressure of the cleaning member 6 may be lowered to reduce wearing, and a cleaning system with less wear such as a brush may be used.

Developing Agent

In the present invention, the developing agent includes a toner containing a toner particle, inorganic silicon fine particles present on the surface of the toner particle, and a metal soap.

Alternatively, in the present invention, the developing agent includes a toner containing a toner particle, organosilicon polymers that cover the surface of the toner particle, and a metal soap.

The toner particles may contain a binder resin as a constituent component.

Examples of binder resins include a polyester resin, a vinyl resin, an epoxy resin, and a polyurethane resin.

The polyester resin may be produced using a method of polycondensating an alcohol component and an acid component, which is generally known.

Vinyl resins may be produced by polymerizing polymerizable monomers such as styrene and derivatives thereof; unsaturated monoolefins; unsaturated polyenes; α-methylene aliphatic monocarboxylic acid esters; acrylic esters; vinyl ketones; acrylic acids such as acrylonitrile, methacrylonitrile, and acrylamide or methacrylic acid derivatives.

The toner particle may contain a release agent. The release agent is not limited as long as it can improve releasability, and examples thereof are as follows.

Aliphatic hydrocarbon waxes such as a polyolefin copolymer, a polyolefin wax, a microcrystalline wax, a paraffin wax, and a Fischer-Tropsch wax.

The content of the release agent is preferably at least 1.0 part by mass and not more than 30.0 parts by mass and more preferably at least 5.0 parts by mass and not more than 25.0 parts by mass with respect to 100.0 parts by mass of the binder resin or polymerizable monomers that produce the binder resin.

Regarding the toner, either a magnetic mono-component toner or a non-magnetic mono-component toner can be used as the toner. However, a non-magnetic mono-component toner is preferable.

Examples of colorants when used as a non-magnetic mono-component toner include conventionally known various dyes and pigments.

Examples of black colorants include carbon black and those that are toned to black using the following yellow, magenta, and cyan colorants.

Examples of yellow colorants include a monoazo compound, a disazo compound, a condensed azo compound, an isoindolinone compound, an anthraquinone compound, an azo metal complex, a methine compound, and an allylamide compound.

Examples of magenta colorants include a monoazo compound, a condensed azo compound, a diketopyrrolopyrrole compound, an anthraquinone compound, a quinacridone compound, a basic dye lake compound, a naphthol compound, a benzimidazolone compound, a thioindigo compound, and a perylene compound.

Examples of cyan colorants include a copper phthalocyanine compound and derivatives thereof, an anthraquinone compound, and a basic dye lake compound.

The content of the colorant is preferably at least 1.0 part by mass and not more than 20.0 parts by mass with respect to 100.0 parts by mass of the binder resin or polymerizable monomers that produce the binder resin.

Examples of inorganic silicon fine particles which may be used in the present invention include silica fine particles such as wet silica fine particles and dry silica fine particles, and hydrophobized silica fine particles obtained by performing a surface treatment on such silica fine particles using a silane coupling agent, a titanium coupling agent, silicone oil or the like.

Dry silica fine particles are produced using, for example, a pyrolysis oxidation reaction of a silicon tetrachloride gas in an oxyhydrogen flame, and the basic reaction formula is as follows.

$$SiCl_4+2H_2+O_2 \rightarrow SiO_2+4HCl$$

In this producing step, other metal halogen compounds such as aluminum chloride or titanium chloride are used together with a silicon halogen compound, and thereby composite fine particles containing silica and other metal oxides can be obtained, and these are also included as inorganic silicon fine particles.

The number-average particle diameter (D1) of primary particles of the inorganic silicon fine particles is preferably 5 nm or more, 10 nm or more, 15 nm or more, 20 nm or more, or 25 nm or more and preferably 500 nm or less, 400 nm or less, 300 nm or less, 250 nm or less, or 200 nm or less. The numerical ranges can be arbitrarily combined.

The content (mass %) of the inorganic silicon fine particles is preferably at least 0.1 parts by mass and not more than 10.0 parts by mass and more preferably at least 1.0 part by mass and not more than 5.0 parts by mass with respect to 100.0 parts by mass of the toner particle.

Meanwhile, when the surface of the toner particle is covered with organosilicon polymers, the toner particles have a surface layer which is a layer present on the outermost surface of the toner particles. That is, the toner particles have a surface layer containing organosilicon polymers. In the surface layer, a portion in which no surface layer is formed on a part of the surface of toner particles may be provided.

The organosilicon polymer preferably has a partial structure represented by the following Formula (1).

$$R—SiO_{3/2} \quad (1)$$

(R represents a hydrocarbon group having at least 1 and not more than 6 carbon atoms.)

In the organosilicon polymer having a partial structure represented by Formula (1), one of four valences of Si atoms is bonded to R, and the remaining three valences are bonded to O atoms. O atoms form a state in which two valences both are bonded to Si, that is, a siloxane bond (Si—O—Si).

In consideration of Si atoms and O atoms in the organosilicon polymer, since three O atoms are provided with respect to two Si atoms, it is represented by $—SiO_{3/2}$.

The $—SiO_{3/2}$ structure of the organosilicon polymer is considered to have properties similar to silica ($SiO_2$) composed of many siloxane bonds. Therefore, since the structure is closer to that of an inorganic material compared to a toner in which the surface layer is formed of a conventional organic resin, the Martens hardness can be made higher than that of the organic resin, and set to be lower than those of inorganic silicon fine particles.

In the partial structure represented by Formula (1), R is a hydrocarbon group having at least 1 and not more than 6 carbon atoms. Thereby, a charge amount is easily stabilized. In particular, an aliphatic hydrocarbon group or phenyl group having at least 1 and not more than 5 carbon atoms, which has excellent environmental stability, is preferable.

In addition, R is more preferably an aliphatic hydrocarbon group having at least 1 and not more than 3 carbon atoms because chargeability and fogging prevention are further improved. When chargeability is favorable, since transferability is favorable and an amount of the residual transfer toner is small, contamination of the drum, the charging member and the transfer member is reduced.

Preferable examples of an aliphatic hydrocarbon group having at least 1 and not more than 3 carbon atoms include a methyl group, an ethyl group, a propyl group, and a vinyl group. In consideration of environmental stability and storage stability, R is more preferably a methyl group.

Regarding an organosilicon polymer production example, a sol-gel method is preferable. The sol-gel method is a method in which a liquid raw material is used as a starting material and subjected to hydrolysis and polycondensation and gelled from a sol state, and is used as a method of synthesizing glass, ceramics, organic-inorganic hybrids, and nanocomposites. When this production method is used, it is possible to produce functional materials with various shapes such as the surface layer, fibers, bulk bodies, and fine particles at a low temperature from a liquid phase.

Specifically, the organosilicon polymer is preferably generated according to hydrolysis and polycondensation of a silicon compound represented by an alkoxysilane.

When the surface containing toner particles is covered with the organosilicon polymer, it is possible to obtain a toner having improved environmental stability, and in which reduction in toner performance during long term use is unlikely to occur, and having excellent storage stability.

In addition, the sol-gel method begins with a liquid, the liquid is gelled to form a material, and thus various micro structures and shapes can be formed. In particular, when toner particles are produced in the aqueous medium, they are easily precipitated on the surface of toner particles due to hydrophilicity of a hydrophilic group such as a silanol group of the organosilicon compound. The micro structure and shape can be adjusted according to the reaction temperature, the reaction time, the reaction solvent, and pH and the type and amount of the organometallic compound and the like.

The organosilicon polymer is preferably a polycondensation product of an organosilicon compound having a structure represented by the following Formula (Z).

[C1]

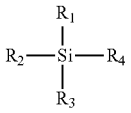

(Z)

(In Formula (Z), $R_1$ represents a hydrocarbon group having at least 1 and not more than 6 carbon atoms, and $R_2$, $R_3$ and $R_4$ each independently represent a halogen atom, a hydroxy group, an acetoxy group, or an alkoxy group)

According to a hydrocarbon group (preferably an alkyl group) for $R_1$, it is possible to improve hydrophobicity and it is possible to obtain toner particles having excellent environmental stability. In addition, regarding a hydrocarbon group, an aryl group which is an aromatic hydrocarbon group, for example, a phenyl group, can be used. When hydrophobicity for $R_1$ is large, a charge amount variation tends to increase in various environments. Therefore, in consideration of environmental stability, $R_1$ is preferably a hydrocarbon group having at least 1 and not more than 3 carbon atoms and more preferably a methyl group.

$R_2$, $R_3$ and $R_4$ each independently represent a halogen atom, a hydroxy group, an acetoxy group, or an alkoxy group (hereinafter referred to as a reactive group). These reactive groups are subjected to hydrolysis, addition polymerization, and polycondensation to form a cross-linked structure, and a toner having excellent anti-member contamination and development durability can be obtained. In consideration of gentle hydrolyzability at room temperature, precipitation of toner particles on the surface, and coatability, an alkoxy group having at least 1 and not more than 3 carbon atoms is preferable, and a methoxy group or an ethoxy group is more preferable. In addition, it is possible to control hydrolysis, addition polymerization and polycondensation for $R_2$, $R_3$ and $R_4$ according to the reaction temperature, the reaction time, the reaction solvent and pH.

In order to obtain the organosilicon polymer, an organosilicon compound (hereinafter referred to as a trifunctional silane) having three reactive groups ($R_2$, $R_3$ and $R_4$) in one molecule except for $R_1$ in Formula (Z) shown above may be used alone or a plurality of types thereof may be used in combination.

Examples of Formula (Z) include the following.

Trifunctional methylsilanes such as methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane.

Trifunctional silanes such as ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane, and hexyltrihydroxysilane.

Trifunctional phenylsilanes such as phenyltrimethoxysilane, phenyltriethoxysilane, phenyltrichlorosilane, phenyltriacetoxysilane, and phenyltrihydroxysilane.

In addition, as long as the effects of the present invention are not impaired, an organosilicon polymer obtained using the following compound together with an organosilicon compound having a structure represented by Formula (Z) may be used. An organosilicon compound having four reactive groups in one molecule (tetrafunctional silane), an organosilicon compound having two reactive groups in one molecule (bifunctional silane), or an organosilicon compound having one reactive group (monofunctional silane).

The content of the organosilicon polymer in the toner particles is preferably at least 0.5 mass % and not more than 10.5 mass %.

The content of the organosilicon polymer can be controlled according to the type and amount of the organosilicon compound used to form the organosilicon polymer, the toner particle production method, the reaction temperature, the reaction time, the reaction solvent and pH when the organosilicon polymer is formed.

The surface layer containing organosilicon polymers and the toner particles are preferably in contact with each other with no gap. Thereby, the occurrence of bleeding due to a resin component, a release agent, or the like further inside than the surface layer of toner particles is reduced, and it is possible to obtain a toner having excellent storage stability, environmental stability, and development durability. In addition to the above organosilicon polymer, a resin such as a styrene-acrylic copolymer resin, a polyester resin, and a urethane resin, various additives, and the like may be incorporated into the surface layer.

The Martens hardness of the toner measured under a condition of a maximum load of $2.0\times10^{-4}$ N is at least 200 MPa and not more than 1,100 MPa.

When the Martens hardness is lower than 200 MPa, the toner easily deforms at a nip between the toner supply roller and the developing roller or a development nip, and the metal soap expands to the toner. As a result, the metal soap is unlikely to be supplied to the photosensitive drum and image smearing is likely to occur.

A preferable value of the Martens hardness is 250 MPa or more, and a more preferable value thereof is 300 MPa or more.

In contrast, when the Martens hardness is larger than 1,100 MPa, the metal soap easily expands due to friction between toners, and image smearing is likely to occur.

A preferable value of the Martens hardness is 1,000 MPa or less, and a more preferable value thereof is 900 MPa or less. The numerical ranges can be arbitrarily combined.

Regarding one means for adjusting the Martens hardness, for example, a method in which the surface layer of a toner is formed with a substance such as an inorganic material having a suitable hardness and additionally, its chemical structure and macro structure are controlled so that it has a suitable hardness may be exemplified.

Specific examples include organosilicon polymers, and the hardness can be adjusted according to the number of carbon atoms directly bonded to silicon atoms of organosilicon polymers, the carbon chain length, and the like by selecting a material. When the surface of the toner particle is covered with organosilicon polymers and has a surface layer, if the number of carbon atoms directly bonded to silicon atoms of the organosilicon polymers is at least 1 and not more than 3 (preferably at least 1 and not more than 2, and more preferably one), this is preferable because it is easy to adjust the hardness to the above specific hardness.

Regarding means for adjusting a Martens hardness according to a chemical structure, adjusting a chemical structure such as crosslinking of a surface layer substance (coating substance) or the degree of polymerization is possible. Regarding means for adjusting a Martens hardness according to a macro structure, adjusting irregularities on the surface layer and a network structure that connects protrusions is possible. When organosilicon polymers are used for the surface layer, such adjusting can be performed by adjusting the pH, concentration, temperature, time, and the like when organosilicon polymers are pretreated. In addition, adjusting can be performed according to a timing at which organosilicon polymers covers core particles of toner particles or a form thereof, the concentration, the reaction temperature, and the like.

A particularly preferable method in the present invention is the following method. First, core particles of toner particles are produced and dispersed in an aqueous medium to obtain a core particle dispersion solution. Regarding the concentration in this case, dispersion is preferably performed at a concentration in which the solid content of core particles is at least 10 mass % and not more than 40 mass % with respect to a total amount of the core particle dispersion solution.

Thus, the temperature of the core particle dispersion solution is preferably adjusted to 35° C. or higher. In addition, the pH of the core particle dispersion solution is preferably adjusted to a pH at which condensation of the organosilicon compound does not proceed easily. Since the pH at which condensation of organosilicon polymers does not proceed easily differs depending on the substance, it is preferably within ±0.5 of the pH at which it is most difficult for the reaction to proceed.

Meanwhile, an organosilicon compound that has been subjected to a hydrolysis treatment is preferably used. For example, as a pretreatment for an organosilicon compound, hydrolysis is performed in another container. Regarding a preparation concentration in hydrolysis, when the amount of the organosilicon compound is 100 parts by mass, at least 40 parts by mass and not more than 500 parts by mass of water from which ionic components such as deionized water and RO water are removed is preferable, and at least 100 parts by mass and not more than 400 parts by mass of water is more preferable. In hydrolysis conditions, preferably, the pH is 2 to 7, the temperature is 15 to 80° C., and the time is 30 to 600 minutes.

The obtained hydrolysis solution and a core particle dispersion solution are mixed and the pH is adjusted to a level suitable for condensation (preferably 6 to 12 or 1 to 3, and more preferably 8 to 12), and thus the surface of the core particles is covered while the organosilicon compound is condensed and the surface layer may be formed. Condensation and surface layer formation are preferably performed at 35° C. or higher for 60 minutes or longer. In addition, the macro structure of the surface can be adjusted by adjusting a time for which the temperature is kept at 35° C. or higher before the pH is adjusted to a level suitable for condensation, and the time is preferably at least 3 minutes and not more than 120 minutes.

Since the reaction residue can be reduced by the above means, irregularities can be formed on the surface layer, and additionally a network structure can be formed between protrusions, a toner having the specific Martens hardness is easily obtained.

Figure 3:
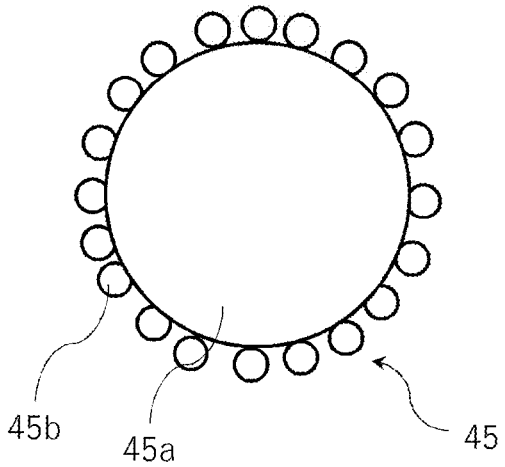
FIG. 3 is a schematic view of a toner.

FIG. 3 shows a schematic view of a toner. The toner is a toner 45 in which inorganic silicon fine particles 45*b* are externally added to a toner particle 45*a* in order to secure fluidity and improve chargeability.

Figure 4:
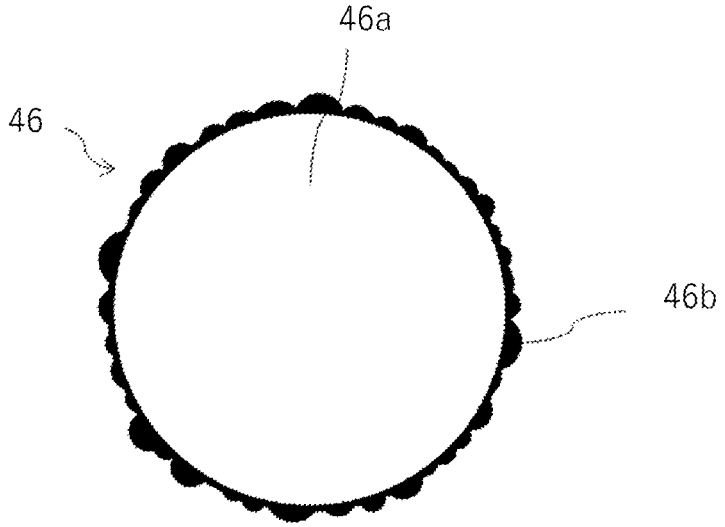
FIG. 4 is a schematic view of a toner.

In addition, FIG. 4 shows a schematic view of a toner. The toner is a toner 46 including a toner particle 46*a* and organosilicon polymers 46b that cover the surface of the toner particle.

The toner used in the embodiment of the present invention is a non-magnetic single-component toner having negatively charged polarity and has a particle diameter of 7 μm.

In addition, in order to reduce image smearing, a metal soap is externally added to the toner. When the metal soap is supplied to a photosensitive drum to form a protective film, it is possible to limit adhesion of a discharge product and the like, and it is possible to reduce the occurrence of image smearing of the photosensitive drum 1.

The metal soap is a generic name for long chain fatty acids and metal salts other than sodium/potassium. Specific examples thereof include metal salts of fatty acids such as stearic acid, myristic acid, lauric acid, ricinoleic acid, octylic acid, and metals such as lithium, magnesium, calcium, barium, and zinc.

More specific examples thereof include lead stearate, cadmium stearate, barium stearate, calcium stearate, aluminum stearate, zinc stearate, magnesium stearate, zinc laurate, and zinc myristate. Here, the type of metal soap is not limited thereto.

In the embodiment of the present invention, zinc stearate is externally added as the metal soap.

The content of the metal soap in the toner is preferably 0.60 mass % or less, 0.50 mass % or less, 0.40 mass % or less, or 0.30 mass % or less. In contrast, the content is preferably 0.05 mass % or more, 0.10 mass % or more, 0.15 mass % or more, or 0.20 mass % or more. The numerical ranges can be arbitrarily combined.

The average particle diameter of the metal soap is preferably at least 0.15 μm and not more than 2.00 μm.

When the particle diameter is smaller than 0.15 μm, it is difficult to supply the metal soap from the toner to grooves on the surface of the photosensitive member. In contrast, when the particle diameter is larger than 2.00 μm, the metal soap is easily released from the toner, and cannot pass through a toner regulating member or the like in a development apparatus, but remains in a developer container, and is difficult to supply to the surface of the photosensitive member.

The average particle diameter of the metal soap is measured by the following method.

10 mL of ethanol is added to 0.5 g of a metal soap and ultrasonic dispersion is performed using an ultrasonic disperser (commercially available from Nippon Seiki Co., Ltd.) for 5 minutes. Next, the obtained metal soap dispersion solution is added to a Microtrac laser diffraction and scattering type particle size distribution measuring device (SPA type, commercially available from Nikkiso Co., Ltd.) in which ethanol as a measurement solvent circulates so that the DV value reaches 0.6 to 0.8. Then, a particle size distribution in this state is measured, and the median diameter is defined as an average particle diameter.

In addition, the metal soap of the average particle diameter may be produced, for example, by a double decomposition method in which a fatty acid salt aqueous solution and an inorganic metal salt aqueous solution or dispersion solution are reacted.

In the embodiment of the present invention, zinc stearate particles having an average particle diameter of 0.60 μm are used. The average particle diameter of zinc stearate particles is preferably 0.15 to 2.00 μm.

When the content is larger, it is more effective in reducing image smearing, but if it is added excessively, fluidity of the toner is lowered, which may influence a solid-image following ability.

In the toner used in the embodiment of the present invention, the amount of water-washing migration of inorganic silicon fine particles or organosilicon polymers is 0.20 mass % or less. The amount of water-washing migration is preferably 0.18 mass % or less, 0.15 mass % or less, or 0.10 mass % or less. In contrast, the content is preferably 0.00 mass % or more. The numerical range can be arbitrarily combined.

The amount of water-washing migration is an index indicating ease with which inorganic silicon fine particles or organosilicon polymers are released. While a detailed measurement method will be described below, if the amount of water-washing migration is large, the amount of inorganic silicon fine particles or organosilicon polymers released is lager, and if the amount of water-washing migration is small, the amount of inorganic silicon fine particles or organosilicon polymers released is small.

When the amount of water-washing migration is 0.20 mass % or less, release of the metal soap resulting from release of inorganic silicon fine particles or organosilicon polymers is restricted, and even if image formation is repeated a plurality of times, the metal soap can be supplied to the photosensitive drum stably for a long time without being exhausted.

Meanwhile, when the amount of water-washing migration exceeds 0.20 mass %, since release of the metal soap is excessive, the metal soap is exhausted from a development part while an image forming operation is repeated a plurality of times, and the amount of the metal soap supplied is insufficient. An insufficient amount of the metal soap supplied is considered to be a major factor in the occurrence of image smearing when image formation is repeated.

The metal soap is charged with a polarity opposite to that of the toner and thus adheres to toner particles, and is supplied onto the photosensitive drum during non-image formation.

Preferably, the toner further includes a discharge product removal agent.

Examples of discharge product removal agents include abrasive particles such as silicon carbide, alumina, cerium oxide silica titanium oxide, strontium titanate and barium titanate; and anion exchange compounds such as magnesium oxide, magnesium hydroxide, magnesium carbonate, aluminum hydroxide-sodium bicarbonate coprecipitates, aluminum hydroxide-magnesium carbonate-calcium carbonate coprecipitates, magnesium silicate, aluminum silicate, lithium aluminate compounds, and hydrotalcite compounds.

It is considered that the substance causing image smearing is nitric acid ($HNO_3$) formed by the reaction between ozone and nitrogen oxide generated in the charging and transfer step and water in air. This nitric acid is ionized into hydrogen ions and nitrate ions, nitrate ions reduce the resistance of the photosensitive drum 1, and thus image smearing occurs.

For example, it is considered that the anion exchange compound removes the discharge product by adsorbing this nitric acid.

Meanwhile, abrasive particles remove the discharge product by polishing the photosensitive drum, but the photosensitive drum itself is polished by polishing.

In order to maintain durability of the photosensitive drum, an anion exchange compound is preferable. In addition, among these, a hydrotalcite compound is preferable.

The hydrotalcite compound is a compound represented by the following Formula (2).

$$M^{2+}_{(1-X)}M^{3+}_{X}(OH)_2A^{n-}_{(X/n)}\cdot mH_2O \quad (2)$$

(In the formula, $M^{2+}$ represents a divalent metal ion, $M^{3+}$ represents a trivalent metal ion, $A^{n-}$ represents an n-valent anion, $0<X\leq 0.5$, $m\geq 0$, an n represents an integer of 1 or more.)

The hydrotalcite compound represented by Formula (2) is a layered compound composed of a positively charged basic layer $[M^{2+}_{(1-X)}M^{3+}_{x}(OH)_2]^{X+}$ and a negatively charged intermediate layer $[A^{n-}_{(x/n)}\cdot mH_2O]^{x-}$, and it can be considered as an intercalation compound in which an intermediate layer is inserted into a basic layer.

In general, it is known that the intercalation compound exhibits a unique chemical property (reactivity). However, it is known that, in the case of the hydrotalcite compound represented by Formula (2), anions ($A^{n-}$) and nitrate ions present in the intermediate layer are easily substituted (anion exchange).

The mechanism of anion exchange is not clear, but it is speculated that the electrical interaction (attraction force) between the basic layer and nitrate ions, the size of the void in the intermediate layer (the thickness of the intermediate layer), an adsorption action, and the like act in a complex manner. It is considered that the hydrotalcite compound captures nitrate ions according to anion exchange and prevents the resistance on the surface of the photosensitive member from decreasing.

Thus, the hydrotalcite compound not only adsorbs nitrate ions according to anion exchange but also has the following unique properties, and thus an image smearing preventing effect is considered to be very strong.

The hydrotalcite compound is insoluble in water and even after adsorption of nitrate ions, it is insoluble in water. That is, the adsorbent itself (including the substance after the adsorption reaction) is not ionized by ionization.

In addition, the hydrotalcite compound is considered to have a $NO_x$ gas (nitrogen oxide) adsorption action. That is, it is considered that the hydrotalcite compound adsorbs a $NO_x$ gas and thus reduces an amount of nitrate ions generated itself.

In addition, among hydrotalcite compounds, a hydrotalcite compound in which $A^{n-}$ is $CO_3^{2-}$ is preferable.

A hydrotalcite that adsorbs a discharge product releases $CO_3^{2-}(A^{n-})$, but most of the generated carbon dioxide is a gas, and thus the electrical resistance value of the surface of the photosensitive member is not lowered.

In addition, hydrotalcite compounds in which $A^{n-}$ is $CO_3^{2-}$ are industrially mass-produced and thus can be obtained at low costs, and $CO_3^{2-}$ is the most preferable example as $A^{n-}$.

Here, in Formula (2), $M^{2+}$; represents any divalent metal ion (for example, $Mg^{2+}$, $Ca^{2+}$, $Sr^{2+}$, $Ba^{2+}$, $Zn^{2+}$, $Ni^{2+}$, $Cd^{2+}$, $Sn^{2+}$, $Pb^{2+}$, $Fe^{2+}$, etc. (of course, the ion is not limited thereto).

$M^{3+}$ represents any trivalent metal ion (for example, $Al^{3+}$, $Fe^{3+}$, $Co^{3+}$, $Bi^{3+}$, $In^{+}$, $Sb^{3+}$, $B^{3+}$, $Ti^{3+}$, etc. (of course, the ion is not limited thereto).

$M^{2+}$ and $M^{3+}$ may be derived from two or more types of metals. In particular, hydrotalcite compounds represented by Formula (3) in which $M^{2+}$ is $Mg^{2+}$, and $M^{3+}$ is $Al^{3+}$ are preferable because they can be industrially obtained at low costs, and has no problem such as toxicity.

$$Mg^{(1-X)}Al^{X}(OH)_2(CO_3)_{X/2}\cdot mH_2O \quad (3)$$

(In the formula, $0<X\leq 0.5$, $m\geq 0$)

The content of the discharge product removal agent in the toner is preferably 0.05 mass % or more, 0.10 mass % or more, 0.15 mass % or more, or 0.20 mass % or more. In contrast, the content is preferably 0.60 mass % or less, 0.50 mass % or less, 0.40 mass % or less, or 0.30 mass % or less. The numerical ranges can be arbitrarily combined.

Regarding a method of producing a toner particle, known methods can be used, and a kneading pulverization method and a wet production method can be used. In consideration of particle diameter uniformity and shape controllability, the wet production method can be preferably used. In addition, examples of wet production methods include a suspension polymerization method, a dissolution suspension method, an emulsion polymerization aggregation method, and an emulsion aggregation method.

Here, the suspension polymerization method will be described. In the suspension polymerization method, first, polymerizable monomers for producing a binder resin, and as necessary, other additives such as a colorant are uniformly dissolved or dispersed using a disperser such as a ball mill and an ultrasonic disperser to prepare a polymerizable monomer composition (step of preparing a polymerizable monomer composition). In this case, as necessary, a multifunctional monomer, a chain transfer agent, a wax as a release agent, a charge control agent, a plasticizer and the like can be appropriately added.

Next, the polymerizable monomer composition is added to an aqueous medium prepared in advance, and droplets made of the polymerizable monomer composition are formed into a toner particle with a desired size using a stirrer or disperser having a high shear force (granulating step).

It is preferable that the aqueous medium in the granulating step contain a dispersion stabilizer in order to control the particle diameter of the toner particle, sharpen the particle size distribution, and reduce aggregation of toner particles in the production procedure.

Dispersion stabilizers are generally broadly classified into polymers that exhibit a repulsive force due to steric hindrance and inorganic compounds with low water solubility that stabilize dispersion with an electrostatic repulsive force. Inorganic compound fine particles with low water solubility are suitably used because they are dissolved in an acid or alkali and thus they can be dissolved and easily removed by washing with an acid or alkali after polymerization.

After the granulating step or while performing the granulating step, the temperature is preferably set to at least 50° C. and not more than 90° C., polymerizable monomers included in the polymerizable monomer composition are polymerized to obtain a toner particle dispersion solution (polymerizing step).

In the polymerizing step, a stirring operation is preferably performed so that the temperature distribution in the container becomes uniform. A polymerization initiator can be added at an arbitrary timing for a required time. In addition, in order to obtain a desired molecular weight distribution, the temperature may be raised in the latter half of the polymerization reaction, and in order to remove unreacted polymerizable monomers, byproducts, and the like to the outside of the system, some of the aqueous medium may be distilled off by a distillation operation in the latter half of the reaction or after the reaction is completed. The distillation operation can be performed under an atmospheric pressure or a reduced pressure.

Regarding the particle diameter of toner particles, in order to obtain a high definition and high-resolution image, the weight-average particle diameter is preferably at least 3.0 μm and not more than 10.0 μm. The weight-average particle diameter of the toner can be measured by a pore electrical resistance method. For example, "Coulter Counter Multisizer 3" (commercially available from Beckman Coulter Inc) can be used for measurement. The toner particle dispersion solution obtained in this manner is subjected to a filtering step for solid-liquid separation of toner particles and the aqueous medium.

The solid-liquid separation for obtaining a toner particle from the obtained toner particle dispersion solution can be performed by a general filtration method. Then, in order to remove foreign substances that are not removed from the surface of the toner particle, it is preferable to perform additional washing according to re-slurry-washing or washing with water. After sufficient washing is performed, solid-liquid separation is performed again to obtain a toner cake. Then, drying is performed by a known drying method, and as necessary, particle groups having a particle diameter other than a predetermined size are separated by classification to obtain a toner particle. In this case, the separated particle groups having a particle diameter other than a predetermined size may be used again in order to improve the final yield.

Regarding a method of forming a surface layer containing organosilicon polymers, when toner particles are formed in an aqueous medium, while performing a polymerization step in the aqueous medium, a hydrolysis solution of the organosilicon compound can be added to form the surface layer as described above. The toner particle dispersion solution after polymerization is used as a core particle dispersion solution, the hydrolysis solution of the organosilicon compound may be added to form the surface layer. In addition, in cases other than the aqueous medium such as a kneading and pulverizing method, the obtained toner particles are dispersed in an aqueous medium and used as a core particle dispersion solution, and the hydrolysis solution of the organosilicon compound can be added to form the surface layer as described above.

Method of Measuring Martens Hardness

The hardness is one of mechanical properties on the surface of an object or in the vicinity of the surface, and indicates resistance of an object to deformation and resistance of an object to scratching when the object is deformed or scratched by a foreign substance, and there are various measurement methods and definitions thereof. For example, measurement methods are properly used depending on the size of the measurement region. In many cases, properly, when the measurement region is 10 μm or more, a Vickers method is used, when the measurement region is 10 μm or less, a nanoindentation method is used, and when the measurement region is 1 μm or less, an AFM is used. Regarding the definition, properly, for example, Brinell hardness or Vickers hardness is used as indentation hardness, Martens hardness is used as scratching hardness, and Shore hardness is used as rebound hardness.

In measurement of the toner, since a general particle diameter is 3 μm to 10 μm, the nanoindentation method is a measurement method that is preferably used. According to the study performed by the inventors, regarding definition of the hardness for expressing effects of the present invention, Martens hardness for representing scratching hardness is appropriate. This is because the scratching hardness can represent strength against the toner that is scratched by a hard substance such as a metal or an external additive in the developing machine.

In a method of measuring the Martens hardness of the toner according to the nanoindentation method, the Martens hardness can be calculated from the obtained load-displacement curve according to indentation test procedures defined in ISO14577-1 using a commercially available device according to ISO14577-1. In the present invention, regarding the device according to the ISO standards, an ultramicro indentation hardness tester "ENT-1100b" (commercially available from Elionix Inc.) is used. The measurement method is described in the "ENT 1100 Operation Manual" bundled in the device, and the specific measurement method is as follows.

Regarding the measurement environment, in a bundled temperature control device, the temperature in a shield case was maintained at 30.0° C. Keeping the ambient temperature constant was effective in reducing variation in measurement data due to thermal expansion, drift, and the like. The set temperature was set to a condition of 30.0° C. assuming the temperature in the vicinity of a developing machine in which the toner was rubbed. Regarding a sample stage, a standard sample stage bundled in the device was used, and after the toner was applied, weak air was blown so that the toner was dispersed, the sample stage was set in the device and held for 1 hour or longer, and measurement was then performed.

Regarding the indenter, a flat indenter (indenter made of titanium, and the tip was made of diamond) of which a tip bundled in the device was a 20 μm square plane was used for measurement. Like the toner, in a spherical object with a small diameter, an object to which an external additive adheres, and an object having irregularities on the surface, a flat indenter was used because a sharp indenter had a great effect on the measurement accuracy. The maximum load in the test was set to $2.0\times10^{-4}$ N. When this test load was set, the hardness could be measured without breaking the surface layer of the toner in a condition corresponding to the stress applied to one toner particle in the development part. In the present invention, since friction resistance was important, it was important to measure the hardness while maintaining the surface layer without breaking.

Regarding particles to be measured, those in which the toner was provided alone in a measurement screen (field size: horizontal width 160 μm, vertical width 120 μm) were selected according to a microscope bundled in the device. Here, in order to eliminate displacement error as much as possible, those of which particle diameter (D) was in a range of ±0.5 μm of the number-average particle diameter (D1) (D1—0.5 μm≤D≤D1+0.5 μm) were selected. Here, in measurement of the particle diameter of the measurement target particles, the long diameter and the short diameter of the toner were measured using software bundled in the device, and [(long diameter+short diameter)/2] was defined as the particle diameter D (μm). In addition, the number-average particle diameter was measured using "Coulter Counter Multisizer 3 (commercially available from Beckman Coulter Inc).

When the hardness was measured, arbitrary 100 toner particles having a particle diameter D (μm) satisfying the above condition were selected and measured. Input conditions during measurement are as follows.

Test mode: load-unload tes.

Test load: 20.000 mgf (=$2.0\times10^{-4}$ N)

Number of divisions: 1,000 steps

Step interval: 10 msec

When the analysis menu "Data Analysis (ISO)" was selected and measurement was performed, the Martens hardness was analyzed using software bundled in the device and output after the measurement. The measurement was performed on 100 toner particles, and the arithmetic average value thereof was defined as the Martens hardness in the present invention.

Measurement of Content of Organosilicon Polymers in Toner Particles

The content of organosilicon polymers was measured using a wavelength dispersive X-ray fluorescence analyzing device "Axios" (commercially available from PANalytical), and bundled dedicated software "SuperQ ver. 4.0F" (commercially available from PANalytical) for measurement condition setting and measurement data analysis. Here, Rh was used as an X-ray tube anode, the measurement atmosphere was a vacuum, the measurement diameter (collimator mask diameter) was 27 mm, and the measurement time was 10 seconds. In addition, when a light element was measured, the proportional counter (PC) was used for detection, and when a heavy element was measured, the scintillation counter (SC) was used for detection.

Regarding a measurement sample, pellets obtained by putting 4 g of toner particles into a dedicated aluminum ring for pressing, performing pressing at 20 MPa for 60 seconds using a tablet molding compressor "BRE-32" commercially available from Maekawa Testing Machine MFG. Co., Ltd.), and performing molding to a thickness of 2 mm and a diameter of 39 mm were used.

0.5 parts by mass of silica ($SiO_2$) fine powder was added with respect to 100 parts by mass of toner particles containing no organosilicon polymer, and the mixture was sufficiently mixed using a coffee mill. In the same manner, 5.0 parts by mass and 10.0 parts by mass of silica fine powder each were mixed together with toner particles, and these were used as calibration curve samples.

Regarding the samples, using a tablet molding compressor, calibration curve sample pellets were produced as described above, and the counting rate (unit: cps) of Si-Kα rays observed at a diffraction angle (2θ)=109.08° when PET was used as a dispersive crystal was measured. In this case, the acceleration voltage and the current value of an X-ray generation device were 24 kV and 100 mA. A linear function calibration curve in which the vertical axis represented the obtained X-ray counting rate and the horizontal axis represented an amount of $SiO_2$ added in each calibration curve sample was obtained.

Next, toner particles to be analyzed were formed into pellets as described above using a tablet molding compressor, and the counting rate of Si-Kα rays was measured. Then, the content of organosilicon polymers in the toner particles was obtained from the above calibration curve.

Measurement of Amount of Water-Washing Migration 160 g of sucrose (commercially available from Kishida Chemical Co., Ltd.) was added to 100 mL of deionized water and dissolved in water bath, and thereby a sucrose concentrated solution was prepared. 31 g of the sucrose concentrated solution and 6 mL of Contaminone N (a 10 mass % aqueous solution of a neutral detergent for washing a precision measurement instrument which included a nonionic surfactant, an anionic surfactant, and an organic builder and had pH 7, commercially available from Wako Pure Chemical Industries, Ltd.) were put into a centrifuge tube (with a volume of 50 ml) to produce a dispersion solution. 1.0 g of the toner was added to the dispersion solution, and the toner was disintegrated using a spatula or the like.

The centrifuge tube was shaken in a shaker at 350 spm (strokes per min), 20 min. After shaking, the solution was moved to a glass tube (with a volume of 50 mL) for a swing rotor, and separated in a centrifuge (H-9R commercially available from Kokusan Co., Ltd.) under conditions of 3,500 rpm for 30 minutes. It was visually confirmed that the toner and the aqueous solution were sufficiently separated, and the toner separated in the top layer was collected using a spatula or the like. The aqueous solution containing the collected toner was filtered in a filtration machine under a reduced pressure, and drying was then performed in a dryer for 1 hour or longer. The dried product was deagglomerated using a spatula, and an amount of silicon or an external additive was measured using X-ray fluorescence (diameter aluminum ring of 10 mm).

The X-ray fluorescence of elements was measured according to JIS K 0119-1969, and details are as follows.

Regarding a measuring device, a wavelength dispersive X-ray fluorescence analyzing device "Axios" (commercially available from PANalytical), and bundled dedicated software "SuperQ ver. 4.0F" (commercially available from PANalytical) for measurement condition setting and measurement data analysis were used. Here, Rh was used as an X-ray tube anode, the measurement atmosphere was a vacuum, the measurement diameter (collimator mask diameter) was 10 mm, and the measurement time was 10 seconds. In addition, when a light element was measured, the proportional counter (PC) was used for detection, and when a heavy element was measured, the scintillation counter (SC) is used for detection.

Regarding a measurement sample, pellets obtained by putting about 1 g of the toner after washing with water and the initial toner into a dedicated aluminum ring for pressing with a diameter of 10 mm and performing pressing, and performing pressing at 20 MPa for 60 seconds using a tablet molding compressor "BRE-32" (commercially available from Maekawa Testing Machine MFG. Co., Ltd.), and performing molding to a thickness of about 2 mm were used.

Measurement was performed under the above conditions, an element was identified based on the obtained X-ray peak position, and its concentration was calculated from a counting rate (unit: cps) which was the number of X-ray photons per unit time.

In a method of determining the amount of silicon in the toner, for example, 0.10 parts by mass of silica ($SiO_2$) fine powder was added with respect to 100 parts by mass of toner particles, and the mixture was sufficiently mixed using a coffee mill. In the same manner, 0.20 parts by mass and 0.50 parts by mass of silica fine powder each were mixed together with toner particles, and these were used as calibration curve samples.

Regarding the samples, using a tablet molding compressor, calibration curve sample pellets were produced as described above, and the counting rate (unit: cps) of Si-Kα rays observed at a diffraction angle (2θ)=109.08° when PET was used as a dispersive crystal was measured. In this case, the acceleration voltage and the current value of an X-ray generation device were 24 kV and 100 mA. A linear function calibration curve in which the vertical axis represents the obtained X-ray counting rate and the horizontal axis represents an amount of $SiO_2$ added in each calibration curve sample was obtained.

Next, the toner to be analyzed was formed into pellets as described above using a tablet molding compressor, and the counting rate of Si-Kα rays was measured. Then, the content (mass %) of $SiO_2$ in the toner was obtained from the above calibration curve. The amount of $SiO_2$ in the toner after washing with water was subtracted from the content of $SiO_2$ in the initial toner calculated by the method to obtain the amount of water-washing migration (mass %).

Contact Development and Peripheral Speed Ratio Setting

In the present embodiment, as described above, the developing roller 17 comes in contact with the photosensitive drum 1 to form a development nip portion. In addition, when a rotational peripheral speed difference is provided between the developing roller 17 and the photosensitive drum 1, the toner rotates at the development nip portion, and the metal soap is supplied to the photosensitive drum 1 (a ratio of the peripheral speed of the developing roller 17 to the peripheral speed of the photosensitive drum 1 is referred to as a DD peripheral speed ratio).

In addition, the inventors of the present invention tried to find a method of stably applying a metal soap to the photosensitive drum 1 through trial and error in experiments and in so doing found that image smearing is likely to be improved when the peripheral speed ratio increases. Increasing the peripheral speed ratio means that a movement speed of the circumferential surface of the developing roller 17 is fast relative to a movement speed of the circumferential surface of the photosensitive drum 1. This is thought to be caused by the fact that, when the peripheral speed ratio increases, a rolling speed of the toner increases and opportunities for the metal soap to come in contact with the photosensitive drum 1 increase.

Here, the peripheral speed ratio is 120% to 300%, and preferably 185% to 290%.

Here, the DD peripheral speed ratio is one index that indicates a difference in the rotational speed between the photosensitive drum 1 and the developing roller 17, and of course, even if, for example, a peripheral speed difference is used as an index in place of the peripheral speed ratio, respective rotational speeds can be obtained. That is, any index can be appropriately used as long as it helps to understand how fast the movement speed of the circumferential surface of the developing roller 17 is relative to the movement speed of the circumferential surface of the photosensitive drum 1.

Relationship Between Blade Bias and Back Contrast

In the present embodiment, various applied biases are adjusted so that a blade bias Vb as a regulatory bias Vb and a dark portion potential Vd of the photosensitive drum 1 satisfy the relationship of Vb>Vd.

Since an unexposed portion in the present embodiment is a dark portion, the dark portion potential Vd can be adjusted by adjusting the magnitude of the charging bias applied to the charging roller 2 as a charging member. For example, in a device that forms a dark portion potential by weak exposure, the magnitude of the dark portion potential Vd can be adjusted by adjusting laser beam power of the scanner unit 3 in addition to adjustment of the charging bias.

The metal soap adheres to the toner 45 with an opposite polarity, and is supplied to the photosensitive drum 1 due to a difference between the dark portion potential of the photosensitive drum 1 and the potential of the developing bias. However, also in a development blade nip portion, the metal soap adheres to the side of the development blade 21 due to a potential difference between the development blade 21 and the developing roller 17.

The inventors of the present invention conducted an experiment for determining a suitable relationship between the blade bias Vb and the dark portion potential Vd of the photosensitive drum 1, and found that, when Vd is smaller than Vb, no image smearing occurs.

This is thought to be caused by the fact that the metal soap can be consumed more in the photosensitive drum 1 when supply of the metal soap to the photosensitive drum 1 has a higher priority than adhesion of the metal soap to the side of the development blade 21.

In addition, the development blade 21 is desirably a blade with low tackiness. This is because, when the tackiness is low, the metal soap can be prevented from adhering to the development blade 21 and consumption of the metal soap in a part other than the photosensitive drum 1 can be minimized. In the embodiment of the present invention, a blade made of stainless steel is used.

In addition, the micro rubber hardness of the developing roller 17 is preferably 30 degrees to 50 degrees.

When the micro rubber hardness is within the above range, the state of the nip portion between the photosensitive drum 1 and the developing roller 17 is optimized, a rolling speed of the toner is suitable, and the balance between consumption and supply of the metal soap is further improved. As a result, the metal soap in which the effect is sustained can be supplied for a long time.

The micro rubber hardness of the developing agent carrying member is measured as follows.

Measurement was performed using a needle with a diameter of 0.16 mm in a micro rubber hardness tester (product name: MD-1capa, commercially available from Kobunshi Keiki Co., Ltd.). In measurement, a value after 2 seconds from weighting is used, and under an environment of a temperature of 25° C. and a relative humidity (RH) of 50% (under L/L environment), an average value obtained by measurement of three parts including the central part, the upper end part, and the lower end part of the developing agent carrying member after a conductive resin layer is formed is used In addition, it is desirable that a potential difference ΔVr between the toner supply roller 20 and the developing roller 17 have a polarity opposite to the polarity of the metal soap. That is, respective bias values are adjusted so that the polarity of the potential difference between the supply bias and the developing bias is opposite to the polarity of the metal soap. Specifically, in the present embodiment, the supply bias is −300 V, and the developing bias is −250 V. When the polarity is set to be opposite, it is possible to maintain the metal soap in the toner supply roller 20, it is possible to prevent an excessive amount of the metal soap from being supplied to the photosensitive drum 1, and it is possible to supply the metal soap stably for a longer time.

EXAMPLES

Hereinafter, unless otherwise specified, "parts" of materials are all based on the mass.

Example 1

A method of producing the toner a to be used will be described.

Step of Preparing Aqueous Medium 1

14.0 parts of sodium phosphate (12 hydrate, commercially available from Rasa Industries, Ltd.) was put into 1000.0 parts of deionized water in a reaction container and the mixture was kept at 65° C. for 1.0 hours while purging with nitrogen gas.

While stirring at 12000 rpm using a T. K. Homomixer (commercially available from Tokushu Kika Kogyo Co., Ltd.), a calcium chloride aqueous solution in which 9.2 parts of calcium chloride (dihydrate) was dissolved in 10.0 parts of deionized water was added together to prepare an aqueous medium containing a dispersion stabilizer. In addition, 10 mass % hydrochloric acid was added to the aqueous medium, pH was adjusted to 5.0, and thereby an aqueous medium 1 was obtained.

Step of Preparing Polymerizable Monomer Composition

| | |
|---|---|
| Styrene | 60.0 parts |
| C. I. Pigment blue 15:3 | 6.5 parts |

The materials were put into an attritor (commercially available from Mitsui Miike Machinery Co., Ltd.), and additionally, dispersion was performed using zirconia particles with a diameter of 1.7 mm at 220 rpm for 5.0 hours to prepare a pigment dispersion solution. The following materials were added to the pigment dispersion solution.

| | |
|---|---|
| Styrene | 20.0 parts |
| n-Butyl acrylate | 20.0 parts |
| Cross-linking agent (divinylbenzene) | 0.3 parts |
| Saturated polyester resin (polycondensate of propylene oxide modified bisphenol A (2 mol adduct) and terephthalic acid (molar ratio 10:12), glass transition temperature Tg = 68° C., weight-average molecular weight Mw = 10000, and molecular weight distribution Mw/Mn = 5.12) | 5.0 parts |
| Fischer-Tropsch wax (melting point 78 °C.): | 7.0 parts |

The mixture was kept at 65° C. and uniformly dissolved and dispersed using a T. K. Homomixer (commercially available from Tokushu Kika Kogyo Co., Ltd.), at 500 rpm to prepare a polymerizable monomer composition.

Granulating Step

The temperature of the aqueous medium 1 was set to 70° C., and while maintaining the rotational speed of the T. K. Homomixer at 12000 rpm, the polymerizable monomer composition was added to the aqueous medium 1, and 9.0 parts of t-butyl peroxypivalate as a polymerization initiator was added. Granulation was performed for 10 minutes while maintaining 12000 rpm in the stirring device without change.

Polymerizing Step

After the granulating step, the stirrer was replaced with a propeller stirring blade, polymerization was performed for 5.0 hours with stirring at 150 rpm while the temperature was maintained at 70° C., and the polymerization reaction was caused by raising the temperature to 85° C. and heating for 2.0 hours. The temperature of the obtained slurry was cooled to obtain a toner particle slurry.

Washing and Drying Step

Hydrochloric acid was added to the toner particle slurry so that pH was adjusted to 1.5 or less, the mixture was stirred and left for 1 hour, and solid-liquid separation was then performed using a pressure filter, and a toner cake was obtained. This was re-slurried with deionized water to make a dispersion solution again, and solid-liquid separation was then performed using the above filter. The re-slurrying and solid-liquid separation were repeated until the electrical conductivity of the filtrate was 5.0 μS/cm or less and finally solid-liquid separation was then performed to obtain a toner cake.

The obtained toner cake was dried using an airflow dryer flash jet dryer (commercially available from Seishin Enterprise Co., Ltd.), and additionally, fine powder was cut using a multi-grade classifier using a Coanda effect to obtain toner particles a. Regarding drying conditions, the blowing temperature was set to 90° C., the dryer outlet temperature was set to 40° C., and the toner cake supply speed was adjusted to a speed at which the outlet temperature did not deviate from 40° C. according to the content of water of the toner cake.

Producing Inorganic Silicon Fine Particles 590.0 g of methanol, 42.0 g of water, and 48.0 g of 28 mass % ammonia water were put into a 3 L glass reaction container including a stirrer, a dripping funnel, and a thermometer, and mixed. The obtained solution was adjusted to 35° C., and while stirring, addition of 1100.0 g (7.23 mol) of tetramethoxysilane and 395.0 g of 5.5 mass % ammonia water started at the same time. Tetramethoxysilane was added dropwise over 6 hours and ammonia water was added dropwise over 5 hours. After dropwise addition was completed, additionally, stirring continued for 0.5 hours, hydrolysis was performed, and thereby a methanol-water dispersion solution containing hydrophilic spherical sol-gel silica fine particles was obtained. Next, an ester adapter and a cooling pipe were attached to the glass reaction container, and the dispersion solution was sufficiently dried at 80° C. under a reduced pressure. The obtained silica particles were heated in a thermostatic tank at 400° C. for 10 minutes.

The obtained silica fine particles were deagglomerated using a pulverizer (commercially available from Hosokawa Micron Corporation).

Then, 500 g of silica fine particles was put into a polytetrafluoroethylene inner cylinder type stainless steel autoclave with an internal volume of 1000 mL. The inside of the autoclave was purged with nitrogen gas. Then, while rotating a stirring blade bundled in the autoclave at 400 rpm, 0.5 g of HMDS (hexamethyldisilazane) and 0.1 g of water were atomized through a two-fluid nozzle and sprayed uniformly to silica fine particles. After stirring for 30 minutes, the autoclave was sealed and heated at 220° C. for 2 hours. Subsequently, the system was depressurized while being heated and subjected to a deammonia treatment, and silica fine particles (inorganic silicon fine particles, the number-average particle diameter of primary particles was 80 nm) were obtained.

External Addition of Inorganic Silicon Fine Particles and Metal Soap

The silica fine particles and a metal soap were externally added to the toner particles a according to the method described in the example in Japanese Patent Application Publication No. 2016-38591, and thereby a toner a was obtained.

That is, with respect to the toner particles a, the silica fine particles (such that the content in the toner satisfied conditions in the table) and zinc stearate (the content in the toner became 0.20 mass %) were subjected to a two-step treatment under conditions shown in the table using a device a (surface modification device) 101 shown in FIG. 7 to FIG. 11. Then, coarse particles were removed using a sieve having 200 meshes, and thereby a toner a was obtained.

Figure 7:
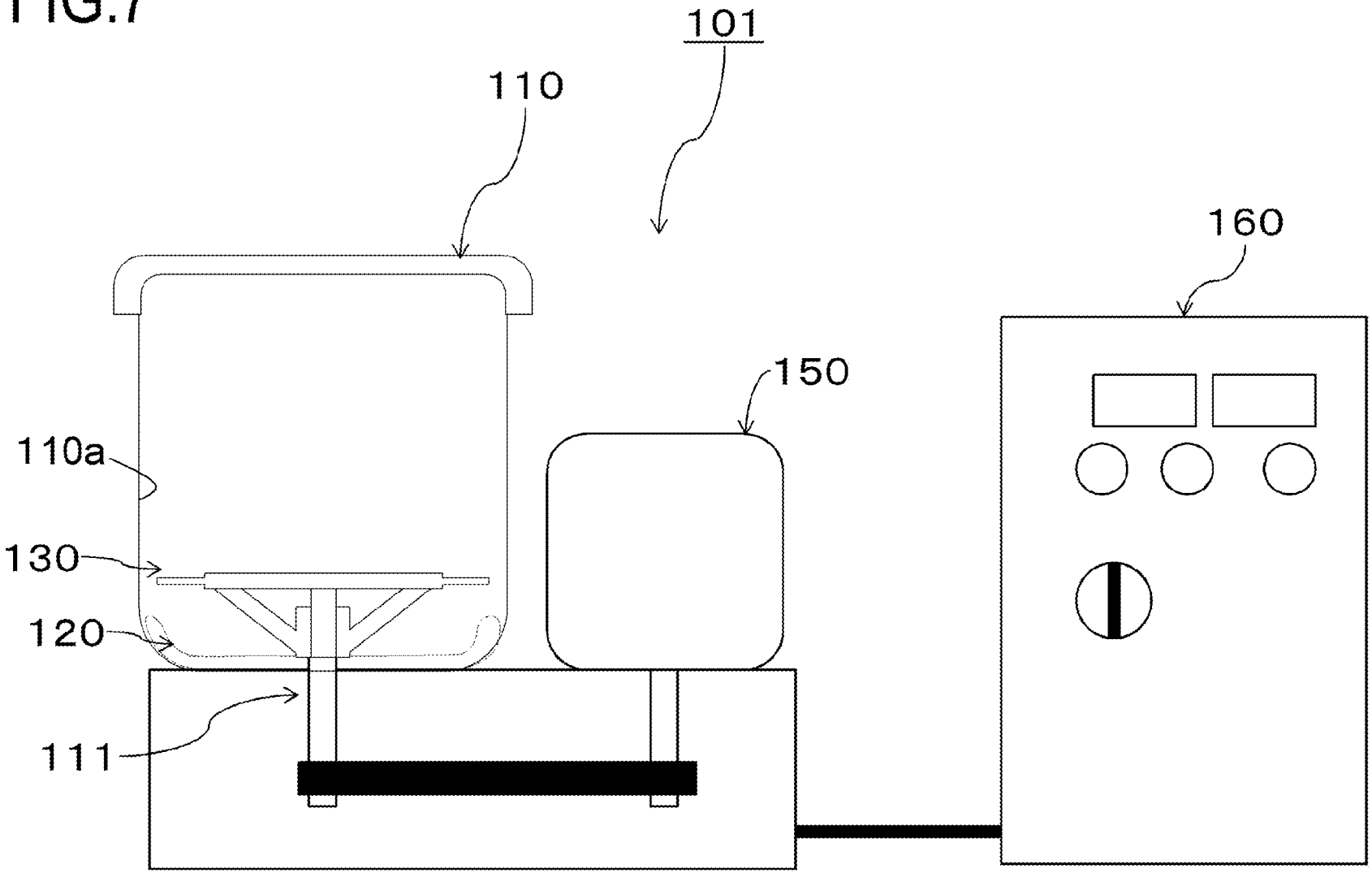
FIG. 7 is a schematic view showing a surface modification device.
Figure 8:
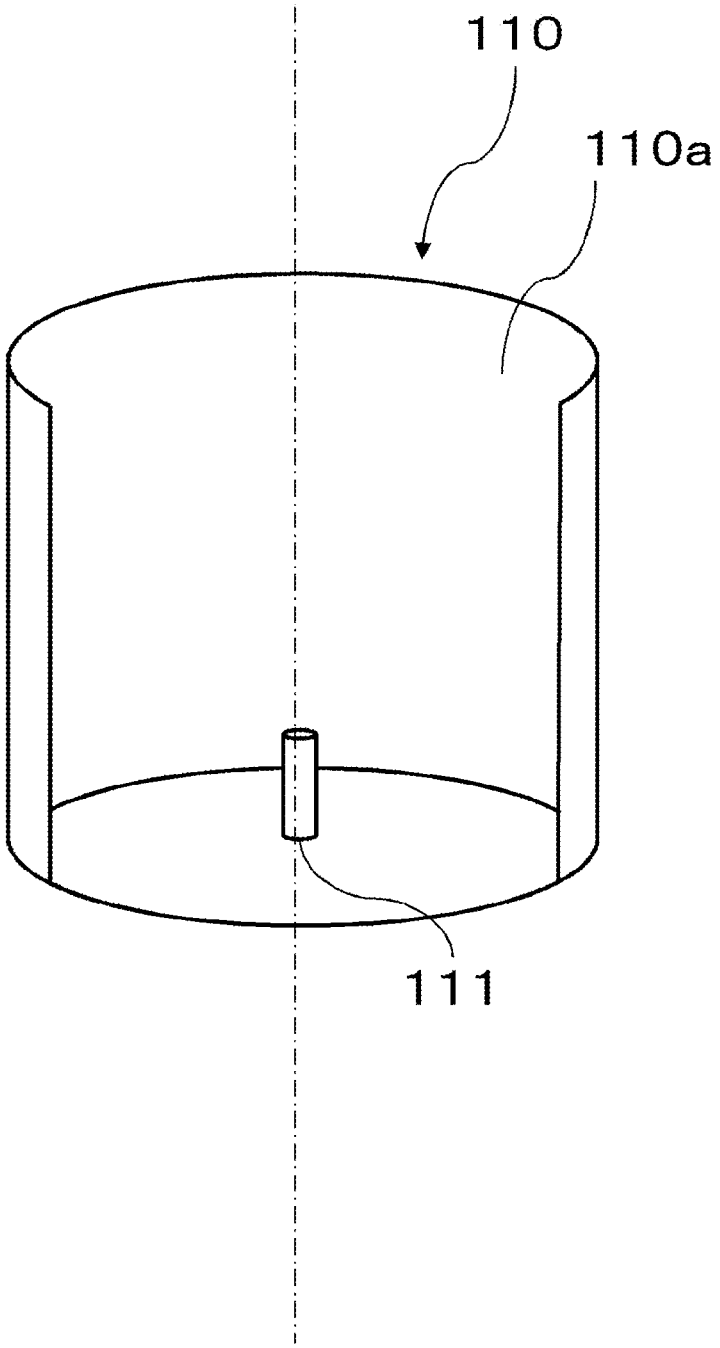
FIG. 8 is a schematic view showing a processing chamber of a surface modification device.
Figure 9A:
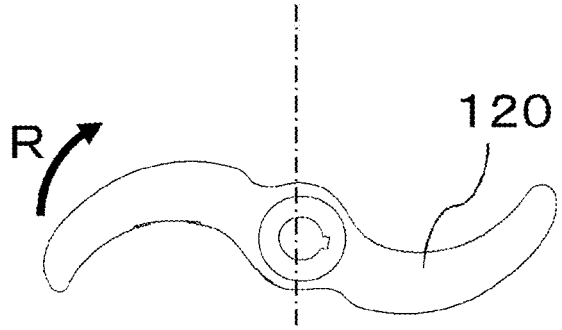
FIGS. 9A and 9B are schematic views showing a stirring blade of a surface modification device.
Figure 9B:
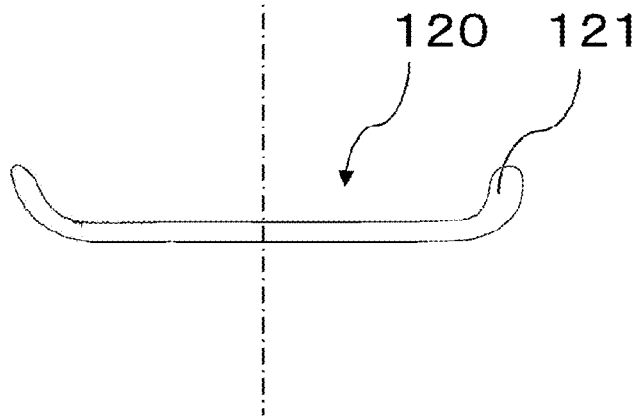
Figure 10A:
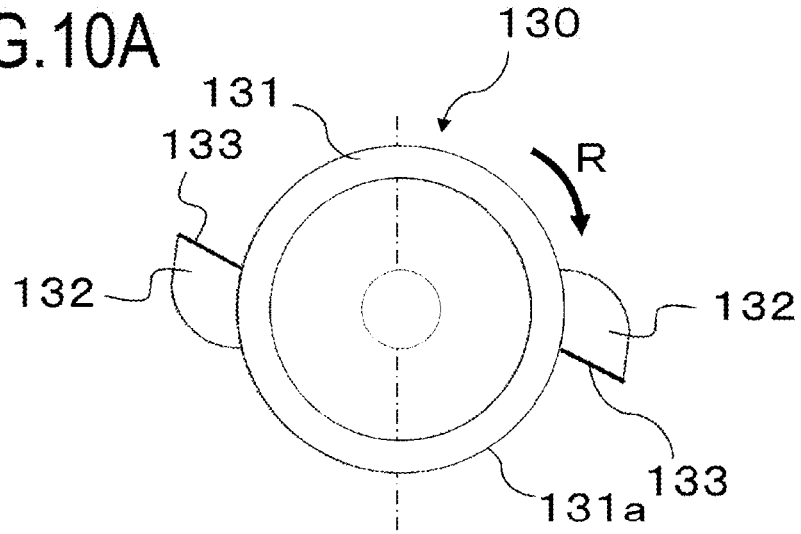
FIGS. 10A and 10B are schematic views showing a rotating body of a surface modification device used in an embodiment of the present invention.
Figure 10B:
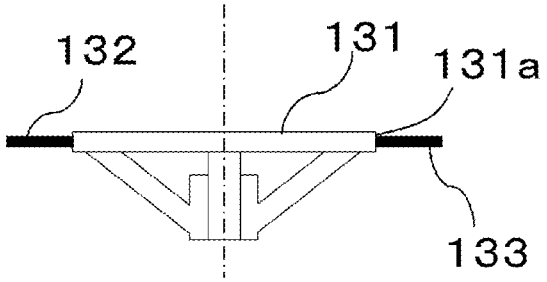
Figure 11A:
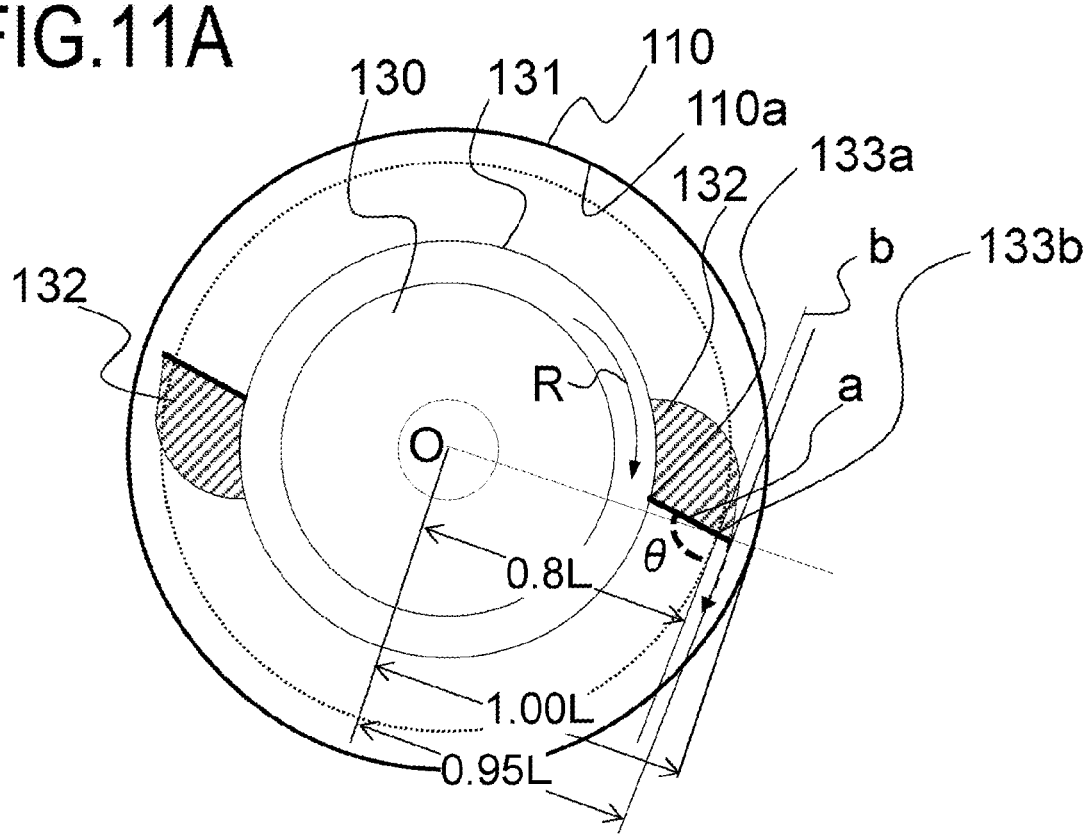
FIGS. 11A, 11B, and 11C are schematic views showing a rotating body of a surface modification device used in an embodiment of the present invention.
Figure 11B:
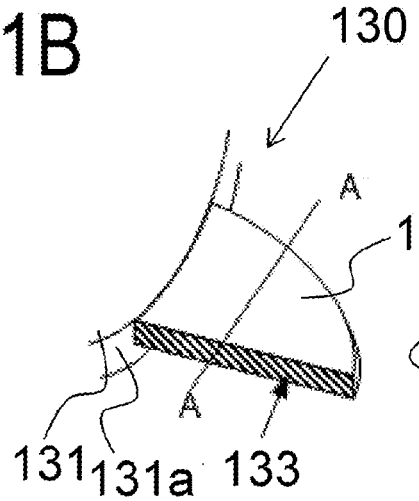
Figure 11C:
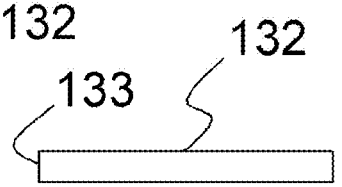

As shown in FIG. 7, the toner processing device 101 includes a processing chamber (processing tank) 110, a stirring blade 120 as a lifting member, a rotating body 130, a drive motor 150, and a control portion 160. In the processing chamber 110, a workpiece containing toner particles and an external additive is stored. The stirring blade 120 is rotatably provided at the bottom of the processing chamber 110 and below the rotating body 130 in the processing chamber. The rotating body 130 is rotatably provided above the stirring blade 120. FIG. 8 shows a schematic view of the processing chamber 110. FIG. 8 shows a state in which an inner circumferential surface (inner wall) 110*a* of the processing chamber 110 is partially cut for convenience of explanation. The processing chamber 110 is a cylindrical container having a substantially flat bottom, and includes a drive shaft 111 for attaching the stirring blade 120 and the rotating body 130 to the substantially center of the bottom. FIGS. 9A and 9B are schematic views of the stirring blade 120 as a lifting member (the top view in FIG. 9A, and the side view in FIG. 9B). When the stirring blade 120 rotates, a workpiece containing toner particles and an external additive can be lifted in the processing chamber 110. The stirring blade 120 has a blade part 121 that extends from the rotation center to the outside (radially outward (outer diameter direction), outer diameter side), and the tip of the blade part 121 has a flip-up shape so that the workpiece is lifted. The stirring blade 120 is fixed to the drive shaft 111 at the bottom of the processing chamber 110 and rotates clockwise (arrow R direction) when viewed from the above (in the state shown in FIG. 9A). When the stirring blade 120 rotates, the workpiece rises while being rotated in the same direction as the stirring blade 120 in the processing chamber 110 and is eventually lowered due to gravity. In this manner, the workpiece is uniformly mixed. FIGS. 10A and 10B and FIGS. 11A, 11B and 11C show schematic views of the rotating body 130. FIG. 10A is a top view of the rotating body 130, and FIG. 10B is a side view thereof. FIG. 11A is a top view showing the rotating body 130 provided in the processing chamber 110. FIG. 11B is a perspective view showing main parts of the rotating body 130, and FIG. 11C is a diagram showing the cross section taken along the line A-A in FIG. 10B. The rotating body 130 is positioned above the stirring blade 120 in the processing chamber 110 and fixed to the same drive shaft 111 for the stirring blade 120, and rotates in the same direction (arrow R direction) as the stirring blade 120. The rotating body 130 includes a rotating body main body 131 and a processing portion 132 having a processing surface 133 that collides with a workpiece according to rotation of the rotating body 130 and processes the workpiece. The processing surface 133 extends from an outer circumferential surface 131*a* of the rotating body main body 131 in the outer diameter direction and is formed such that a region of the processing surface 133 away from the rotating body main body 131 is positioned downstream in the rotation direction of the rotating body 130 from a region closer to the rotating body main body 131 than the region. That is, in FIG. 1(*a*), the processing surface 133 is disposed so that it is inclined in the rotation direction R of the rotating body 130 with respect to the radial direction of the rotating body 130. When the rotating body 130 rotates, the workpiece collides with the processing surface 133, the external additive aggregate is deagglomerated.

The amount of water-washing migration of the silica fine particles in the toner a obtained by this method was adjusted by changing a wing tip peripheral speed (in the table, described as a "peripheral speed") and time during the two-step treatment.

Hereinafter, Table 1 shows external addition conditions of the toner a and the amount of water-washing migration (mass %) of silica fine particles.

Here, the toner used in this example was negatively charged, and the metal soap was externally added by charging it with a polarity opposite to that of the toner.

Here, the DD peripheral speed ratio of the image forming apparatus used was 140%.

In addition, Vb was set to −450 v so that Vb>Vd was satisfied for Vd=−500 v.

In addition, the bias of the toner supply roller 20 was set to −350 v so that ΔVr=−50 v was satisfied.

TABLE 1

| | First step external addition conditions | | | | Second step external addition conditions | | | | |
|---|---|---|---|---|---|---|---|---|---|
| | Content of silica fine particles (mass %) | Device | Peripheral speed (m/s) | Time (sec) | Content of silica fine particles (mass %) | Device | Peripheral speed (m/s) | Time (sec) | Amount of water-washing migration (mass %) |
| Toner a | 0.60 | Device a | 40 | 300 | 0.60 | Device a | 40 | 60 | 0.20 |

Example 2

A toner b was obtained in the same manner as in Example 1 except that external addition conditions were changed as shown in Table 2.

In Example 2, the configuration was obtained in the same manner in Example 1 except that the toner b was used.

Hereinafter, Table 2 shows external addition conditions of the toner b and the amount of water-washing migration (mass %) of silica fine particles.

TABLE 2

| | First step external addition conditions | | | | Second step external addition conditions | | | | |
|---|---|---|---|---|---|---|---|---|---|
| | Content of silica fine particles (mass %) | Device | Peripheral speed (m/s) | Time (sec) | Content of silica fine particles (mass %) | Device | Peripheral speed (m/s) | Time (sec) | Amount of water-washing migration (mass %) |
| Toner b | 0.60 | Device a | 40 | 300 | 0.60 | Device a | 44 | 60 | 0.15 |

Examples 3 to 5

The configuration was obtained in the same manner as in Example 1 except that the DD peripheral speed ratio was changed to 120% (Example 3), 200% (Example 4), and 300% (Example 5).

Comparative Examples 1 and 2

The configuration was obtained in the same manner as in Example 1 except that the DD peripheral speed ratio was changed to 110% (Comparative Example 1) and 320% (Comparative Example 2).

Comparative Example 3

The configuration was obtained in the same manner as in Example 1 except that Vb was set to −550 v so that Vb<Vd was satisfied for Vd=−500 v.

Comparative Example 4

A toner c was obtained in the same manner as in Example 1 except that external addition conditions were changed as shown in Table 3.

In Comparative Example 4, the configuration was obtained in the same manner as in Example 1 except that the toner c was used.

Table 3 shows external addition conditions of the toner c and the amount of water-washing migration (mass %) of silica fine particles.

TABLE 3

| | First step external addition conditions | | | | Second step external addition conditions | | | | |
|---|---|---|---|---|---|---|---|---|---|
| | Content of silica fine particles (mass %) | Device | Peripheral speed (m/s) | Time (sec) | Content of silica fine particles (mass %) | Device | Peripheral speed (m/s) | Time (sec) | Amount of water-washing migration (mass %) |
| Toner c | 0.8 | Device a | 40 | 300 | 0.8 | Device a | 40 | 60 | 0.24 |

Evaluation

In order to check the occurrence of image smearing in Examples 1 to 5, and Comparative Examples 1 to 4, under an environment of 32° C. and an RH of 80%, 10,000 sheets per day were continuously passed at a 1% print percentage and then left in the machine for a day. The presence or absence of image smearing after being left was compared. Here, the total number of sheets that passed was 50,000 sheets.

One halftone image was printed whenever 10,000 sheets were passed, and evaluation was performed based on the following criteria.

O: There was no whitening due to latent image rounding or contour blurring at the boundary of the image in the entire image x: Whitening due to latent image rounding or contour blurring at the boundary of the image occurred in a part of the image or the entire image The results are shown in Table 4.

TABLE 4

| | Toner | Peripheral speed ratio (%) | Vb (V) | Vd (V) | Number of sheets that passed (*$10^3$) 10 | 20 | 30 | 40 | 50 |
|---|---|---|---|---|---|---|---|---|---|
| Example 1 | a | 140 | −450 | −500 | O | O | O | O | O |
| Example 2 | b | 140 | −450 | −500 | O | O | O | O | O |
| Example 3 | a | 120 | −450 | −500 | O | O | O | O | O |
| Example 4 | a | 200 | −450 | −500 | O | O | O | O | O |
| Example 5 | a | 300 | −450 | −500 | O | O | O | O | O |
| Comparative Example 1 | a | 110 | −450 | −500 | x | x | x | x | x |
| Comparative Example 2 | a | 320 | −450 | −500 | O | O | O | x | x |
| Comparative Example 3 | a | 140 | −550 | −500 | O | O | x | x | x |
| Comparative Example 4 | c | 140 | −450 | −500 | O | O | O | x | x |

As shown in Table 4, in Examples 1 to 5, no image smearing occurred.

However, when the DD peripheral speed ratio was 110% (Comparative Example 1), image smearing occurred on the 10,000th sheet. This is thought to be caused by the fact that, since the DD peripheral speed ratio was not sufficient, the rolling speed of the toner was low, and opportunities for the metal soap to come in contact with the photosensitive drum decrease so that supply of the metal soap to the photosensitive drum was insufficient.

In addition, when the DD peripheral speed ratio exceeded 300% as in Comparative Example 2, no image smearing occurred up to the 30,000th sheet, but image smearing occurred on the 40,000th sheet. This is thought to be caused by the fact that, if the peripheral speed ratio was too large, since the rolling speed of the toner was too high, an excessive amount of the metal soap was supplied in the initial stage, and exhausted in the long term, and friction became intense and caused the metal soap to be spread on the toner.

As shown in this example, when the peripheral speed ratio was in a range of 120% to 300%, image smearing occurred up to the 50,000th sheet.

This means that, in order to supply the metal soap from the toner with a small amount of silica fine particles released to the photosensitive drum, it was necessary to adjust the peripheral speed ratio to be within a specific range and to have opportunities for the metal soap to come in contact with the photosensitive drum.

Based on the results, it was found that the DD peripheral speed ratio needs to be 120% to 300% in a configuration in which the metal soap was stably applied to the surface of the photosensitive member for a long time so that the occurrence of image smearing was reduced.

In contrast, in Comparative Example 3, image smearing occurred on the 30,000th sheet. It was thought that, when the blade bias was higher than the dark portion potential of the photosensitive drum, an amount of the metal soap supplied to the photosensitive drum was smaller and image smearing occurred earlier than those of the example.

In addition, in Comparative Example 4 using a toner having a large amount of water-washing migration, no image smearing was observed up to the 30,000th sheet, but image smearing occurred on the 40,000th sheet.

In the toner c, there was a large amount of silica fine particles released, an amount of the metal soap released accordingly increased, and an excessive amount of the metal soap was supplied in the initial stage so that no image smearing occurred. However, it is thought that, when image formation was repeated, the metal soap that can be supplied was exhausted.

Generally, when wearing of the photosensitive drum was reduced, the surface of the photosensitive drum was unlikely to be refreshed, and image defects called image smearing occurred in a high humidity environment. Regarding the toner, a toner to which a metal soap was externally added was effective in preventing image smearing. However, when silica fine particles released, the metal soap also released, and when image formation was repeated, it was not possible to reduce the occurrence of image smearing.

However, in the configuration of this example, using a toner in which an amount of silica fine particles released was reduced, it was possible to prevent an excessive amount of the metal soap from being supplied and exhausted in the initial stage and also in a toner in which the metal soap was unlikely to be released, it was possible to reduce the occurrence of image smearing for a long time using a configuration in which the metal soap was stably applied.

Here, the setting conditions used for explanation in this example and the embodiment of the present invention are only examples and the present invention is not limited thereto.

The form in which a developing agent included a toner containing a toner particle, inorganic silicon fine particles present on the surface of the toner particle, and a metal soap has been described above.

The inventors conducted experiments in which the form of the surface of the toner particle was changed under a condition in which an amount of water-washing migration of the external additive was the same, and found that the following form 2 was preferable.

That is, the developing agent included a toner containing a toner particle, organosilicon polymers covering the surface of the toner particle, and a metal soap, and an amount of water-washing migration of the organosilicon polymers was 0.20 mass % or less, and the Martens hardness of the toner measured under a condition of a maximum load of $2.0\times10^{-4}$ N was at least 200 MPa and not more than 1,100 MPa.

When the form was used, it was possible to further reduce the occurrence of image smearing with a simple configuration while maintaining durability of the photosensitive member even if an apparatus configuration had a longer lifespan.

Example 6

A method of producing a toner d used is shown.

(Step of Preparing Aqueous Medium 2)

14.0 parts of sodium phosphate (12 hydrate, commercially available from Rasa Industries, Ltd.) was put into 1000.0 parts of deionized water in a reaction container and the mixture was kept at 65° C. for 1.0 hours while purging with nitrogen gas.

While stirring at 12000 rpm using a T. K. Homomixer (commercially available from Tokushu Kika Kogyo Co., Ltd.), a calcium chloride aqueous solution in which 9.2 parts of calcium chloride (dihydrate) was dissolved in 10.0 parts of deionized water was added together to prepare an aqueous medium containing a dispersion stabilizer. In addition, 10 mass % hydrochloric acid was added to the aqueous medium, pH was adjusted to 5.0, and thereby an aqueous medium 2 was obtained.

Step of Hydrolyzing Organosilicon Compound for Surface Layer 60.0 parts of deionized water was weighed out in a reaction container including a stirrer and a thermometer, and pH was adjusted to 3.0 using 10 mass % of hydrochloric acid. The result was heated with stirring and the temperature was set to 70° C. Then, 40.0 parts of methyltriethoxysilane which was an organosilicon compound for a surface layer was added and the mixture was stirred for 2 hours or longer and hydrolyzed. At the end point of hydrolysis, it was visually confirmed that oil and water were not separated but formed one layer, cooling was performed, and a hydrolysis solution of an organosilicon compound for a surface layer was obtained.

Step of Preparing Polymerizable Monomer Composition

| | |
|---|---|
| Styrene | 60.0 parts |
| C. I. Pigment blue 15:3 | 6.5 parts |

The materials were put into an attritor (commercially available from Mitsui Miike Machinery Co., Ltd.), and additionally, dispersion was performed using zirconia particles with a diameter of 1.7 mm at 220 rpm for 5.0 hours to prepare a pigment dispersion solution. The following materials were added to the pigment dispersion solution.

| | |
|---|---|
| Styrene | 20.0 parts |
| n-Butyl acrylate | 20.0 parts |
| Cross-linking agent (divinylbenzene) | 0.3 parts |
| Saturated polyester resin (polycondensate of propylene oxide modified bisphenol A (2 mol adduct) and terephthalic acid (molar ratio 10:12), glass transition temperature Tg = 68° C., weight-average molecular weight Mw = 10000, and molecular weight distribution Mw/Mn = 5.12) | 5.0 parts |
| Fischer-Tropsch wax (melting point 78° C.) | 7.0 parts |

The mixture was kept at 65° C. and uniformly dissolved and dispersed using a T. K. Homomixer (commercially available from Tokushu Kika Kogyo Co., Ltd.), at 500 rpm to prepare a polymerizable monomer composition.

Granulating Step

The temperature of the aqueous medium 2 was set to 70° C., and while maintaining the rotational speed of the T. K. Homomixer at 12000 rpm, the polymerizable monomer composition was added to the aqueous medium 2, and 9.0 parts of t-butyl peroxypivalate as a polymerization initiator was added. Granulation was performed for 10 minutes while maintaining 12000 rpm in the stirring device without change.

Polymerizing Step

After the granulating step, the stirrer was replaced with a propeller stirring blade, polymerization was performed for 5.0 hours with stirring at 150 rpm while the temperature was maintained at 70° C., and the polymerization reaction was caused by raising the temperature to 85° C. and heating for 2.0 hours, and thereby core particles were obtained. When the temperature of the slurry was cooled at 55° C. and pH was measured, pH was 5.0. While stirring continued at 55° C., 20.0 parts of a hydrolysis solution of an organosilicon compound for a surface layer was added and formation of the surface layer of the toner particle started. After maintaining for 30 minutes without change, the slurry was adjusted to pH=9.0 for completing condensation using a sodium hydroxide aqueous solution, and was additionally left for 300 minutes, and the surface layer was formed.

Washing and Drying Step

After the polymerizing step was completed, the toner particle slurry was cooled, and hydrochloric acid was added to the toner particle slurry so that pH was adjusted to 1.5 or less, the mixture was stirred and left for 1 hour, and solid-liquid separation was then performed using a pressure filter, and a toner cake was obtained. This was re-slurried with deionized water to make a dispersion solution again, and solid-liquid separation was then performed using the above filter. The re-slurrying and solid-liquid separation were repeated until the electrical conductivity of the filtrate was 5.0 μS/cm or less and finally solid-liquid separation was then performed to obtain a toner cake.

The obtained toner cake was dried using an airflow dryer flash jet dryer (commercially available from Seishin Enterprise Co., Ltd.), and additionally, fine powder was cut using a multi-grade classifier using a Coanda effect to obtain toner particles. Regarding drying conditions, the blowing temperature was set to 90° C., the dryer outlet temperature was set to 40° C., and the toner cake supply speed was adjusted to a speed at which the outlet temperature did not deviate from 40° C. according to the content of water of the toner cake.

Silicon mapping was performed in observation of the cross section of the toner particle d under a TEM, and it was confirmed that silicon atoms were present on the surface layer. In the following examples also, it was confirmed that, in the surface layer containing organosilicon polymers, silicon atoms were present on the surface layer according to the same silicon mapping.

External Addition Step

The obtained toner particle d was dried and mixed using a Henschel mixer (FM-10C commercially available from Mitsui Mining Co., Ltd.) so that the content of zinc stearate in the toner was 0.20 mass % and thereby a toner d was obtained. Physical properties of the toner d are shown in Table 5.

Here, the DD peripheral speed ratio of the image forming apparatus used was 140%.

In addition, Vb was set to −450 v so that Vb>Vd was satisfied for Vd=−500 v.

In addition, the bias of the toner supply roller 20 was set to −350 v so that ΔVr=−50 v.

Production Conditions and Physical Properties of Toners are Shown in Table 5.

Examples 7 and 8, and Comparative Examples 5 and 6

Toners e to h were obtained in the same manner as in Example 6 except that production conditions of the toners were changed as shown in Table 5. The physical properties of the toners are shown in Table 5.

Evaluation

In order to check the occurrence of image smearing in Examples 6 to 8, and Comparative Examples 5 and 6, evaluation was performed using the same method and criteria as in Example 1. Here, the total number of sheets that passed was 80,000 sheets.

The results are shown in Table 6.

TABLE 6

| | Type of toner | Number of sheets that passed (*$10^3$) | | | | | | | |
|---|---|---|---|---|---|---|---|---|---|
| | | 10 | 20 | 30 | 40 | 50 | 60 | 70 | 80 |
| Example 1 | a | O | O | O | O | O | x | x | x |
| Example 6 | d | O | O | O | O | O | O | O | O |
| Example 7 | e | O | O | O | O | O | O | O | O |
| Example 8 | f | O | O | O | O | O | O | O | O |
| Comparative Example 5 | g | O | O | O | x | x | x | x | x |
| Comparative Example 6 | h | O | O | O | x | x | x | x | x |

In the toners of Examples 6 to 8, no image smearing occurred up to the 80,000th sheet.

The reason for this was inferred as follows. Since the organosilicon polymers were softer than the silica fine particles, expansion of the metal soap due to friction between toners was further reduced.

Meanwhile, as in Comparative Example 5, when the Martens hardness was lower than 200 Mpa, image smearing occurred on the 40,000th sheet. This was thought to be caused by the fact that, when the Martens hardness was lower than 200 Mpa, the toner was likely to be deformed at the nip between the toner supply roller and the developing roller or the development nip, the metal soap expanded to the toner, and thus it was unlikely to be supplied to the photosensitive drum.

In addition, also in Comparative Example 6, image smearing occurred on the 40,000th sheet. This was thought to be caused by the fact that, when the Martens hardness exceeded 1,100 MPa, the metal soap was likely to expand due to friction between toners.

Here, the setting conditions used for explanation of this example were only examples, and the present invention is not limited thereto.

The configuration in which the occurrence of image smearing was reduced by stably supplying the metal soap to the photosensitive drum 1 for a long time has been described above.

TABLE 5

| Type of toner | Number of parts of polymerization initiator added | Number of parts of cross-linking agent added | Type of organosilicon compound for surface layer | Conditions when hydrolysis solution is added: pH of slurry | Temperature of slurry | Number of parts of hydrolysis solution added | Conditions after addition Retention time until pH for completing condensation is adjusted | Amount of water-washing migration (mass %) | Martens hardness (MPa) |
|---|---|---|---|---|---|---|---|---|---|
| d | 9.0 | 0.3 | Methyltriethoxysilane | 5.0 | 55 | 20.0 | 30 | 0.08 | 598 |
| e | | | | 9.0 | 70 | 20.0 | 0 | 0.10 | 203 |
| f | | | | 5.0 | 40 | 20.0 | 90 | 0.13 | 1092 |
| g | | | | 9.5 | 65 | 20.0 | 0 | 0.18 | 190 |
| h | | | | 5.0 | 40 | 20.0 | 100 | 0.13 | 1110 |

The inventors conducted further experiments and found that, when a discharge product removal agent and a metal soap were externally added together, release of the discharge product removal agent from the toner was reduced.

The reason for this was inferred as follows. The metal soap serves as a kind of "paste" and makes the discharge product removal agent remain on the surface of the toner and release thereof is reduced.

Therefore, using a toner in which release of the metal soap and the discharge product removal agent was reduced, also in a configuration with a longer lifespan, it was possible to reduce the occurrence of image smearing with a simple configuration and control while maintaining durability of the photosensitive member.

Configuration of Toner Supply Roller

In the following examples and comparative examples, the relationship between rotation directions of the toner supply roller 20 and the developing roller 17 was changed.

Figure 5:
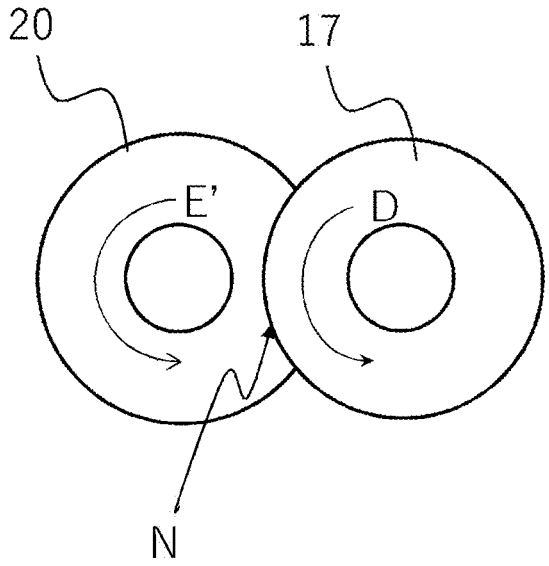
FIG. 5 is a diagram showing a direction of rotation of a developing roller and a toner supply roller.

Hereinafter, description will be made with reference to FIG. 5.

The toner supply roller 20 and the developing roller 17 rotate in a direction in which surfaces thereof move from the lower end to the upper end of the nip portion N. That is, the toner supply roller 20 rotates in a direction indicated by the arrow E' in the drawing (counterclockwise), and the developing roller 17 rotates in a direction indicated by the arrow D (counterclockwise), and movement directions of the respective surfaces at the position at which they are in contact with each other are opposite to each other.

In such a configuration, the toner supply roller 20 and the developing roller 17 rotate in directions opposite to each other at the nip portion N with a peripheral speed difference (a ratio of the peripheral speed of the toner supply roller 20 to the peripheral speed of the developing roller 17 is referred to as a DRs peripheral speed ratio).

Due to rotation in opposite directions, the stripping force of the toner is larger than in a configuration in which forward rotation occurs, and the discharge product removal agent is unlikely to remove due to the "paste" effect of the metal soap, the metal soap can be released from the toner and supplied to the photosensitive drum 1.

In such a configuration, the DRs peripheral speed ratio is preferably 70% to 150%.

Here, the DRs peripheral speed ratio is one index that indicates a difference in the rotational speed between the toner supply roller 20 and the developing roller 17, and of course, even if, for example, a peripheral speed difference is used as an index in place of the peripheral speed ratio, the same rotational speeds can be obtained.

In order to confirm the effect when the metal soap and the discharge product removal agent were externally added, the toner a in which zinc stearate as a metal soap and a hydrotalcite compound represented by Formula (3) as a discharge product removal agent were externally added to the toner particle a was used.

20,000 sheets were continuously passed in the same manner as in the evaluation of Example 1, and the toner in the toner container (developing agent container) 18*e* was collected, an amount of the hydrotalcite compound was measured, and the relationship between the amount of zinc stearate externally added and the amount of change in the hydrotalcite compound was determined.

The amount of the hydrotalcite compound externally added to the toner a after the sheets were continuously passed was measured according to the method described in (measurement of content of organosilicon polymers) in which elements to be measured were set as magnesium and aluminum.

In addition, the content of the hydrotalcite compound in the toner was 0.20 mass %.

In addition, in the configuration of the apparatus, the DRs peripheral speed ratio was 110%. The other conditions were the same as in Example 1.

The results are shown in Table 7. Based on the results, it was found that, when zinc stearate was externally added, an amount of change in the hydrotalcite compound was reduced.

This can be inferred that the zinc stearate served as a kind of "paste", and made the hydrotalcite compound remain on the surface of the toner particle and release thereof was reduced. In addition, it was found that, when the amount of zinc stearate externally added was 0.20 mass % or more, release was greatly reduced.

TABLE 7

| Content of zinc stearate (mass %) | Content of hydrotalcite compound of toner in developing agent container at initial time (mass %) | Content of hydrotalcite compound of toner in developing agent container when 20,000 sheets are continuously passed (mass %) | Amount of change in content of hydrotalcite compound (mass %) |
|---|---|---|---|
| 0 | 0.20 | 0.05 | 0.15 |
| 0.10 | 0.20 | 0.10 | 0.10 |
| 0.20 | 0.20 | 0.16 | 0.04 |
| 0.30 | 0.20 | 0.18 | 0.02 |

Example 9

A toner i was obtained in the same manner as in Example 1 except that the content of zinc stearate in the toner was changed to 0.20 mass %, and the content of the hydrotalcite compound in the toner was changed to 0.20 mass %. Here, the amount of water-washing migration of silica fine particles in the toner i was 0.20 mass %.

In addition, as in Example 1, the DD peripheral speed ratio was 140%, Vb was −450 v, Vd was −500 v, and Vb>Vd was satisfied.

In addition, the bias of the toner supply roller was −350 v, and $\Delta Vr=-50$ v was satisfied.

The toner supply roller 20 and the developing roller 17 rotated in directions opposite to each other at the nip portion N with a peripheral speed difference, and the DRs peripheral speed ratio was 110%.

Example 10

The configuration was obtained in the same manner as in Example 9 except that the DRs peripheral speed ratio was 70%.

Example 11

The configuration was obtained in the same manner as in Example 9 except that the DRs peripheral speed ratio was 150%.

Example 12

A toner j was obtained in the same manner as in Example 9 except that content of zinc stearate in the toner was changed to 0.10 mass %, and the content of the hydrotalcite compound in the toner was changed to 0.10 mass %. Here, the amount of water-washing migration of silica fine particles in the toner j was 0.20 mass %.

Example 13

A toner k was obtained in the same manner as in Example 9 except that the content of zinc stearate in the toner was changed to 0.20 mass %, and the content of the hydrotalcite compound in the toner was changed to 0.10 mass %. Here, the amount of water-washing migration of silica fine particles in the toner k was 0.20 mass %.

Example 14

A toner 1 was obtained in the same manner as in Example 9 except that the content of zinc stearate in the toner was changed to 0.10 mass %, and the content of the hydrotalcite compound in the toner was changed to 0.20 mass %. Here, the amount of water-washing migration of silica fine particles in the toner 1 was 0.20 mass %.

Example 15

A toner m was obtained in the same manner as in Example 6 except that the content of zinc stearate in the toner was changed to 0.20 mass % and the content of the hydrotalcite compound in the toner was changed to 0.20 mass %. Here, the amount of water-washing migration of organosilicon polymers in the toner m was 0.08 mass %.

In addition, as in Example 9, the DD peripheral speed ratio was 140%, Vb was −450 v, Vd was −500 v, and Vb>Vd was satisfied.

The bias of the toner supply roller was −350 v, and ΔVr=−50 v.

The toner supply roller 20 and the developing roller 17 rotated in directions opposite to each other at the nip portion N with a peripheral speed difference, and the DRs peripheral speed ratio was 110%.

Example 16

The configuration was obtained in the same manner as in Example 9 except that the DRs peripheral speed ratio was 160%.

Example 17

The configuration was obtained in the same manner as in Example 9 except that the DRs peripheral speed ratio was 65%.

Comparative Example 7

A toner n was obtained in the same manner as in Example 9 except that no zinc stearate was externally added, and the content of the hydrotalcite compound in the toner was changed to 0.20 mass %. Here, the amount of water-washing migration of silica fine particles in the toner n was 0.20 mass %.

Evaluation

In order to check the occurrence of image smearing in Examples 9 to 17, and Comparative Example 7, evaluation was performed using the same method and criteria as in Example 1. Here, the total number of sheets that passed was 120,000 sheets.

The results are shown in Table 8.

TABLE 8

| | Type of toner | Number of sheets that passed (*$10^3$) | | | | | | | | | | | |
|---|---|---|---|---|---|---|---|---|---|---|---|---|---|
| | | 10 | 20 | 30 | 40 | 50 | 60 | 70 | 80 | 90 | 100 | 110 | 120 |
| Example 1 | a | O | O | O | O | O | x | x | x | x | x | x | x |
| Example 9 | i | O | O | O | O | O | O | O | O | O | O | x | x |
| Example 10 | i | O | O | O | O | O | O | O | O | O | O | x | x |
| Example 11 | i | O | O | O | O | O | O | O | O | O | O | x | x |
| Example 12 | j | O | O | O | O | O | O | x | x | x | x | x | x |
| Example 13 | k | O | O | O | O | O | O | O | O | x | x | x | x |
| Example 14 | l | O | O | O | O | O | O | O | x | x | x | x | x |
| Example 15 | m | O | O | O | O | O | O | O | O | O | O | O | O |
| Example 16 | i | O | O | O | O | x | x | x | x | x | x | x | x |
| Example 17 | i | O | O | O | O | x | x | x | x | x | x | x | x |
| Comparative Example 7 | n | x | x | x | x | x | x | x | x | x | x | x | x |

In Examples 9 to 11, no image smearing occurred up to the 100,000th sheet. In Examples 12, 13, and 14, the occurrence of image smearing was reduced for a long time although it was not comparable with those in Examples 9 to 11.

Based on the results, it was found that, when the DRs peripheral speed ratio was in a range of 70% to 150%, the occurrence of image smearing was reduced for a longer time.

This was thought to be caused by the fact that zinc stearate made the hydrotalcite compound remain on the surface of the toner particle and reduced release thereof, and thus the hydrotalcite compound was unlikely to be exhausted even if image formation was repeated. In addition, this means that, even if the hydrotalcite compound was unlikely to release, when the DRs peripheral speed ratio was set to 70% to 150%, it was possible to supply the hydrotalcite compound stably to the photosensitive drum 1.

In addition, it was found that image smearing was reduced for a longer time in Example 9 than in Examples 12 to 14.

This reflects the results in which the content of zinc stearate was 0.20 parts by mass or more and release of the hydrotalcite compound was greatly reduced.

In contrast, in Example 16, image smearing occurred on the 50,000th sheet.

This is because, when the DRs peripheral speed ratio was higher than a specific range, an action of releasing the hydrotalcite compound tended to become stronger, and when the number of sheets that passed increased, the amount of the hydrotalcite compound supplied decreased in some cases.

In addition, in Example 17, image smearing occurred on the 50,000th sheet.

This is because, when the DRs peripheral speed ratio was smaller than a specific range, an action of releasing the hydrotalcite compound tended to become weaker, and the amount of the hydrotalcite compound supplied decreased in some cases.

In addition, in Comparative Example 7, image smearing occurred on the 10,000th sheet. This was thought to be caused by the fact that no protective film was formed on the photosensitive drum 1 because no zinc stearate was contained.

In Example 15, no image smearing occurred up to the 120,000th sheet.

This is because the developing agent included a toner containing a toner particle, organosilicon polymers covering the surface of the toner particle, and a metal soap, and the Martens hardness of the toner measured in a condition of a maximum load of $2.0\times10^{-4}$ N was 200 Mpa to 1,100 Mpa. It was thought that, when the toner was used, the metal soap was unlikely to expand and the Martens hardness of the toner was higher than that of the resin of the surface of the toner particle so that the hydrotalcite compound was prevented from being embedded in the toner particle.

According to the present invention, using a toner in which the amount of inorganic silicon fine particles released was reduced, it was possible to prevent an excessive amount of the metal soap from being supplied and exhausted in the initial stage and it was possible to maintain an effect of the discharge product removal agent for a long time using the metal soap and the discharge product removal agent in combination.

In addition, also in the toner in which the metal soap and the discharge product removal agent were unlikely to release, using a configuration in which the toner can be stably supplied to the photosensitive drum 1, it was possible to reduce image smearing for a longer time.

In addition, using a toner containing a toner particle having a surface layer containing organosilicon polymers and in which the Martens hardness of the toner measured in a condition of a maximum load of $2.0\times10^{-4}$ N was 200 Mpa to 1,100 Mpa, and the amount of water-washing migration of organosilicon polymers was 0.20 mass % or less, the metal soap was unlikely to expand and an effect of preventing the discharge product removal agent from being embedded in the toner particle was exhibited. Therefore, it was possible to reduce the occurrence of image smearing for a longer time. Here, the setting conditions used for explanation of this example were only examples, and the present invention is not limited thereto.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-213853, filed on Nov. 14, 2018, which is hereby incorporated by reference herein in its entirety.

What is claimed is:

1. An image forming apparatus comprising:

an image bearing member;

a latent image forming portion that forms a light portion potential and a dark portion potential on a surface of the image bearing member and thus forms an electrostatic image on the image bearing member;

a storage chamber storing a developing agent;

a developing agent carrying member that comes in contact with the image bearing member and develops the electrostatic image formed on the image bearing member using the developing agent;

a regulating member that regulates the developing agent that the developing agent carrying member carries to develop the electrostatic image; and a regulatory bias application portion that applies a regulatory bias Vb to the regulating member, wherein the developing agent in the storage chamber includes a toner containing a toner particle, inorganic silicon fine particles present on a surface of the toner particle, and a metal soap, wherein the amount of water-washing migration of the inorganic silicon fine particles is 0.20 mass % or less, wherein a peripheral speed ratio of a peripheral speed of the developing agent carrying member to a peripheral speed of the image bearing member has a range of 120% to 300%, and wherein a dark portion potential Vd on the surface of the image bearing member and the regulatory bias satisfy the relationship of Vd<Vb.

2. An image forming apparatus comprising:

an image bearing member;

a latent image forming portion that forms a light portion potential and a dark portion potential on a surface of the image bearing member and thus forms an electrostatic image on the image bearing member;

a storage chamber storing a developing agent;

a developing agent carrying member that comes in contact with the image bearing member and develops the electrostatic image formed on the image bearing member using the developing agent;

a regulating member that regulates the developing agent that the developing agent carrying member carries to develop the electrostatic image; and a regulatory bias application portion that applies a regulatory bias Vb to the regulating member, wherein the developing agent in the storage chamber includes a toner containing a toner particle, organosilicon polymers covering the surface of the toner particle, and a metal soap, wherein the amount of water-washing migration of the organosilicon polymers is 0.20 mass % or less, wherein the Martens hardness of the toner measured in a condition of a maximum load of 2.0×10-4 N is at least 200 MPa and not more than 1,100 MPa, wherein a peripheral speed ratio of a peripheral speed of the developing agent carrying member to a peripheral speed of the image bearing member, has a range of 120% to 300%, and wherein a dark portion potential Vd on the surface of the image bearing member and the regulatory bias satisfy the relationship of Vd<Vb.

3. The image forming apparatus according to claim 1, wherein a content of the metal soap in the toner is 0.20 mass % or more.

4. The image forming apparatus according to claim 1, further comprising:

a supply member that comes in contact with the developing agent carrying member and supplies the developing agent to the developing agent carrying member, wherein a movement direction on the surface of the supply member is opposite to a movement direction on the surface of the developing agent carrying member at a position in contact with the developing agent carrying member, wherein a peripheral speed ratio, which is a ratio of a peripheral speed of the supply member to a peripheral speed of the developing agent carrying member, has a range of 70% to 150%, and wherein the toner further contains a discharge product removal agent.

5. The image forming apparatus according to claim 4, wherein a content of the discharge product removal agent in the toner is 0.20 mass % or more.

6. The image forming apparatus according to claim 4, wherein the discharge product removal agent is an anion exchange compound.

7. The image forming apparatus according to claim 6, wherein the anion exchange compound is a hydrotalcite compound.

8. The image forming apparatus according to claim 2, wherein the organosilicon polymers have a partial structure represented by the following formula:

$$R—SiO_{3/2},$$

where R represents a hydrocarbon group having at least 1 and not more than 6 carbon atoms.

9. The image forming apparatus according to claim 1, wherein the image bearing member includes a protective layer on an outermost surface layer.

10. The image forming apparatus according to claim 9, wherein the protective layer contains an acrylic resin.

11. The image forming apparatus according to claim 1, wherein the metal soap contains at least one metal selected from the group consisting of zinc, calcium, and magnesium.

12. The image forming apparatus according to claim 1, wherein the metal soap is zinc stearate, calcium stearate, or magnesium stearate.

13. The image forming apparatus according to claim 1, wherein the average particle diameter of the metal soap is at least 0.15 μm and not more than 2.00 μm.

14. The image forming apparatus according to claim 1, wherein the regulating member is made of stainless steel.

15. The image forming apparatus according to claim 1, wherein the micro rubber hardness of the developing agent carrying member is 30 degrees to 50 degrees.

16. The image forming apparatus according to claim 1, further comprising:

a developing bias application portion that applies a developing bias to the developing agent carrying member, wherein the polarity of a potential difference between the developing bias and the regulatory bias is opposite to the polarity of the metal soap.

17. The image forming apparatus according to claim 1, wherein the latent image forming portion includes:

a charging portion that charges the image bearing member to form the dark portion potential, the charging portion including a charging member that comes in contact with the image bearing member and a charging bias application portion that applies a charging bias to the charging member, and an exposure portion that exposes the charged image bearing member and forms the light portion potential.

18. The image forming apparatus according to claim 1, wherein the developing agent carrying member and a supply member that comes in contact with the developing agent carrying member rotate at a nip portion so that surfaces thereof move in an identical direction, and supplies a developing agent to the developing agent carrying member.

19. The image forming apparatus according to claim 18, wherein, in an orientation during use, the developing agent carrying member and the supply member rotate so that surfaces thereof move in a direction from the top to the bottom at the nip portion.

20. The image forming apparatus according to claim 1, wherein, in an orientation during use, a position at which the regulating member comes in contact with the developing agent carrying member is below a nip portion at which the developing agent carrying member comes in contact with a supply member that comes in contact with the developing agent carrying member and supplies a developing agent to the developing agent carrying member.

21. The image forming apparatus according to claim 1, wherein, in an orientation during use, a position at which the regulating member comes in contact with the developing agent carrying member is below a rotation center of the developing agent carrying member and is between the rotation center of the developing agent carrying member and a rotation center of a supply member that comes in contact with the developing agent carrying member and supplies the developing agent to the developing agent carrying member in the horizontal direction.

22. The image forming apparatus according to claim 1, further comprising:

a frame body that includes the storage chamber, wherein the developing agent carrying member, a supply member that comes in contact with the developing agent carrying member and supplies a developing agent to the developing agent carrying member, and the regulating member are attached to the frame body, wherein the regulating member has one end that is fixed to the frame body and the other end as a free end that comes in contact with the developing agent carrying member, and wherein a direction that extends from the one end to the other end is opposite to a direction in which the developing agent carrying member rotates at a portion in contact with the developing agent carrying member.

23. The image forming apparatus according to claim 22, wherein:

the frame body further includes:

a developing chamber in which the developing agent carrying member, the supply member, and the regulating member are disposed, the storage chamber being positioned below the developing chamber in an orientation during use and, and a partition wall including a communication port that allows communication between the storage chamber and the developing chamber, and the apparatus further includes a transport member disposed in the storage chamber and conveys the developing agent from the storage chamber to the developing chamber via the communication port.

24. The image forming apparatus according to claim 23, wherein an upper end of the communication port is above an upper end of the supply member.

25. The image forming apparatus according to claim 23, wherein a lower end of the communication port is above a lower end of the supply member.

* * * * *